US007464459B1

(12) United States Patent
Niblock et al.

(10) Patent No.: US 7,464,459 B1
(45) Date of Patent: Dec. 16, 2008

(54) METHOD OF FORMING A MEMS ACTUATOR AND RELAY WITH VERTICAL ACTUATION

(75) Inventors: Trevor Niblock, Santa Clara, CA (US); Peter Johnson, Sunnyvale, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 11 days.

(21) Appl. No.: 11/807,161

(22) Filed: May 25, 2007

(51) Int. Cl.
*H01H 11/00* (2006.01)
*H01H 11/02* (2006.01)
*H01H 11/04* (2006.01)
*H01H 65/00* (2006.01)

(52) U.S. Cl. ..... 29/622; 29/606; 29/825; 29/830; 29/843; 29/846; 257/E21.218; 257/415; 257/419; 257/619; 257/684; 361/277; 361/278; 361/280; 361/281; 438/52; 438/53; 438/71; 438/121

(58) Field of Classification Search ..... 29/611, 29/622, 825, 830, 843, 846, 874; 216/33, 216/36, 80; 257/E21.218, 415, 419, 619, 257/684; 361/277, 278, 280, 281; 438/52, 438/53, 71, 121
See application file for complete search history.

(56) References Cited

U.S. PATENT DOCUMENTS 5,880,921 A * 3/1999 Tham et al. ..... 361/233
6,169,826 B1 1/2001 Nishiyama et al. ..... 385/22
6,360,036 B1 3/2002 Couillard ..... 385/19
6,573,822 B2 * 6/2003 Ma et al. ..... 336/223
7,095,919 B2 8/2006 Kawamoto et al. ..... 385/18
7,381,663 B2 * 6/2008 Sato et al. ..... 257/415
2004/0022484 A1 2/2004 Sigloch et al. ..... 385/22

OTHER PUBLICATIONS

Gary D. Gray Jr., et al. "Magnetically Bistable Actuator Part 2. Fabrication and Performance", Sensors and Actuators A: Physical, vol. 119, Issue 2, Apr. 13, 2005, pp. 502-511.
Gary D. Gray Jr. and Paul A. Kohl, "Magnetically Bistable Actuator Part 1. Ultra-Low Switching Energy And Modeling", Sensors and Actuators A: Physical, vol. 119, Issue 2, Apr. 13, 2005, pp. 489-501.
John A. Wright, et al., "Micro-Miniature Electromagnetic Switches Fabricated Using MEMS Technology", Proceedings: 46th Annual International Relay Conference: NARM '98, Oak Brook, Illinois, Apr. 1998, pp. 13-1 to 13-4.

(Continued)

*Primary Examiner*—Paul D Kim
(74) *Attorney, Agent, or Firm*—Mark C. Pickering

(57) ABSTRACT

A method of forming an actuator and a relay using a micro-electromechanical (MEMS)-based process is disclosed. The method first forms the lower sections of a square copper coil, and then forms a magnetic core member. The magnetic core member, which lies directly over the lower coil sections, is electrically isolated from the lower coil sections. The method next forms the side and upper sections of the coil, followed by the formation of an overlying cantilevered magnetic flexible member. Switch electrodes, which are separated by a switch gap, can be formed on the magnetic core member and the magnetic flexible member, and closed and opened in response to the electromagnetic field that arises in response to a current in the coil.

20 Claims, 51 Drawing Sheets

OTHER PUBLICATIONS

Han S. Lee, et al., "Micro-Electro-Mechanical Relays—Design Concepts and Process Demonstrations", Joint 22nd International Conference on Electrical Contacts and 50th IEEE HOLM Conference Electrical Contacts, Sep. 20-23, 2004, pp. 242-247.

J.H. Fabian, et al., "Maxtrix Combination of MEMS Relays", 17th IEEE International Conference on Micro Electro Mechanical Systems, 2004, pp. 861-864.

Ernst Thielicke and Ernst Obermeier, "A Fast Switching Surface Micromachined Electrostatic Relay", The 12th International Conference on Solid State Sensors, Actuators and Microsystems, Boston, Jun. 8-12, 2003, pp. 899-902.

Ren Wanbin, et al., "Finite Element Analysis of Magnetic Structures for Micro-Electro-Mechanical Relays", Proceedings of the 51st IEEE HOLM Conference on Electrical Contacts, Sep. 26-28, 2005, pp. 265-269.

John A. Wright, et al., "Magnetostatic MEMS Relays For The Miniaturization Of Brushless DC Motor Controllers", 12th IEEE International Conference on Micro Electro Mechanical Systems, Jan. 17-21, 1999, pp. 594-599.

U.S. Appl. No. 11/805,933, filed May 25, 2007, Niblock et al.

U.S. Appl. No. 11/805,934, filed May 25, 2007, Niblock et al.

U.S. Appl. No. 11/805,955, filed May 25, 2007, Niblock et al.

U.S. Appl. No. 11/807,162, filed May 25, 2007, Niblock et al.

* cited by examiner

METHOD OF FORMING A MEMS ACTUATOR AND RELAY WITH VERTICAL ACTUATION

BACKGROUND OF THE INVENTION

1. Field of the Invention

The present invention relates to actuators and relays and, more particularly, to a method of forming a MEMS actuator and relay with vertical actuation.

2. Description of the Related Art

A switch is a well-known device that connects, disconnects, or changes connections between devices. An electrical switch is a switch that provides a low-impedance electrical pathway when the switch is "closed," and a high-impedance electrical pathway when the switch is "opened." A mechanical-electrical switch is a type of switch where the low-impedance electrical pathway is formed by physically bringing two electrical contacts together, and the high-impedance electrical pathway is formed by physically separating the two electrical contacts from each other.

An actuator is a well-known mechanical device that moves or controls a mechanical member to move or control another device. Actuators are commonly used with mechanical-electrical switches to move or control a mechanical member that closes and opens the switch, thereby providing the low-impedance and high-impedance electrical pathways, respectively, in response to the actuator.

A relay is a combination of a switch and an actuator where the mechanical member in the actuator moves in response to electromagnetic changes in the conditions of an electrical circuit. For example, electromagnetic changes due to the presence or absence of a current in a coil can cause the mechanical member in the actuator to close and open the switch.

One approach to implementing actuators and relays is to use micro-electromechanical (MEMS) technology. MEMS devices are formed using the same fabrication processes that are used to form conventional semiconductor devices, such as bipolar and CMOS transistors. Although a number of approaches exist for forming MEMS actuators and relays, there is a need for an additional approach to forming MEMS actuators and relays.

BRIEF DESCRIPTION OF THE DRAWINGS

FIGS. 1A-14A are plan views illustrating a method of forming a MEMS actuator 100 in accordance with the present invention.

FIGS. 1B-14B are cross-sectional views taken along lines 1B-1B of FIGS. 1A through 14B-14B of FIG. 14A, respectively.

FIGS. 1C-14C are cross-sectional views taken along lines 1C-1C of FIGS. 1A through 14C-14C of FIG. 14A, respectively.

FIGS. 1D-14D are cross-sectional views taken along lines 1D-1D of FIG. 1A through 14D-14D of FIG. 14A, respectively.

FIGS. 1E-14E are cross-sectional views taken along lines 1E-1E of FIGS. 1A through 14E-14E of FIG. 14A, respectively.

FIGS. 15A-29A are plan views illustrating a method of forming a MEMS relay 1500 in accordance with the present invention.

FIGS. 15B-29B are cross-sectional views taken along lines 15B-15B of FIGS. 15A through 29B-29B of FIG. 29A, respectively.

FIGS. 15C-29C are cross-sectional views taken along lines 15C-15C of FIGS. 15A through 29C-29C of FIG. 29A, respectively.

FIGS. 15D-29D are cross-sectional views taken along lines 15D-15D of FIGS. 15A through 29D-29D of FIG. 29A, respectively.

FIGS. 15E-29E are cross-sectional views taken along lines 15E-15E of FIGS. 15A through 29E-29E of FIG. 29A, respectively.

DETAILED DESCRIPTION OF THE INVENTION

Figure 1A:
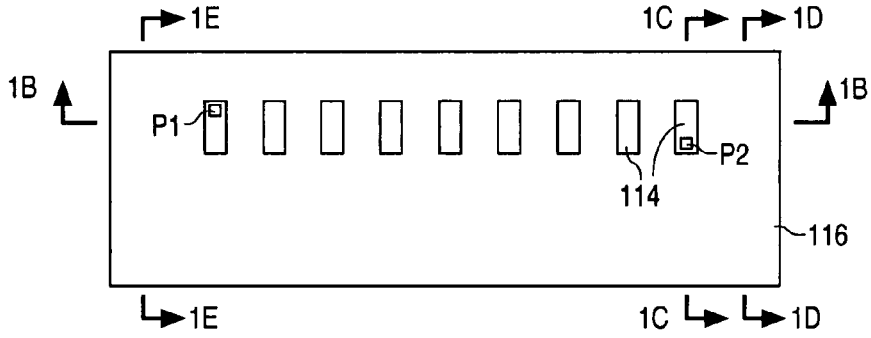
Figure 1B:
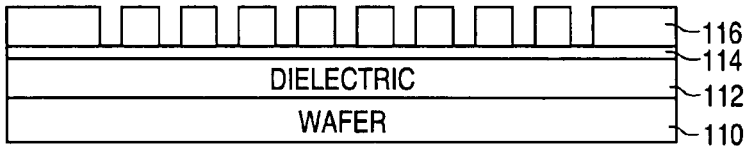
Figure 1C:
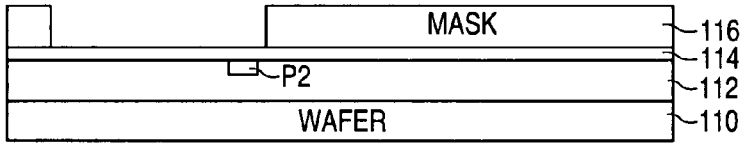
Figure 1D:
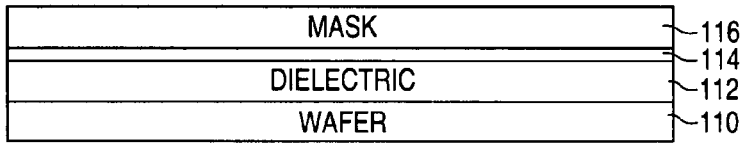
Figure 1E:
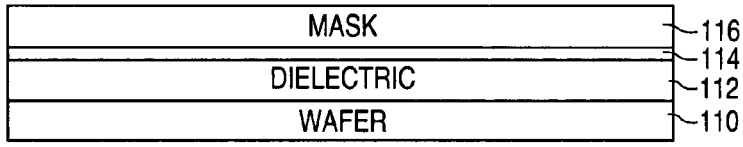
Figure 2A:
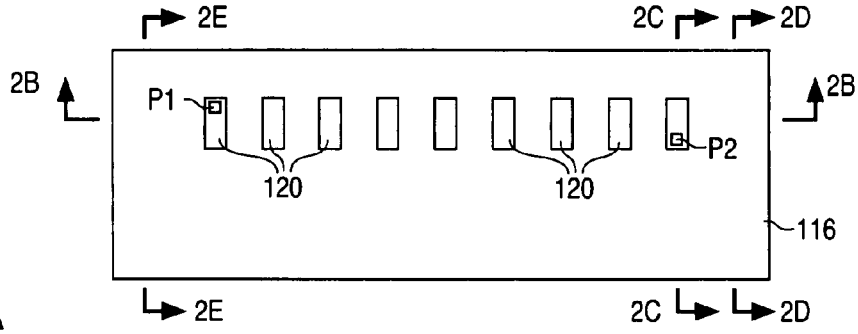
Figure 2B:
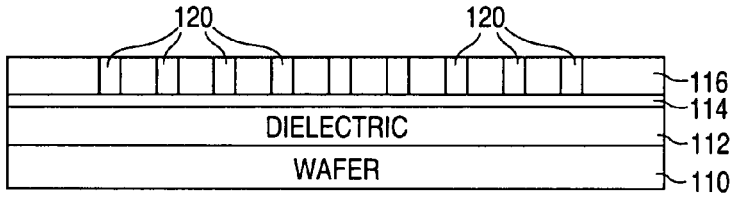
Figure 2C:
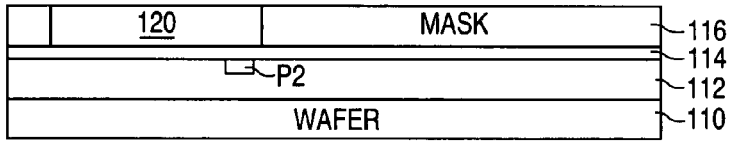
Figure 2D:
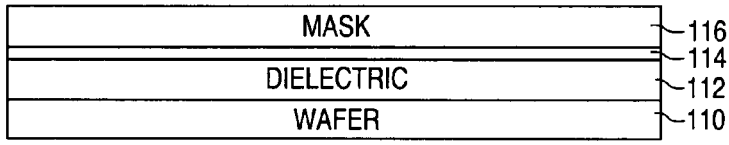
Figure 2E:
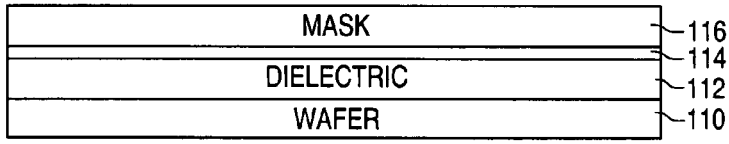
Figure 3A:
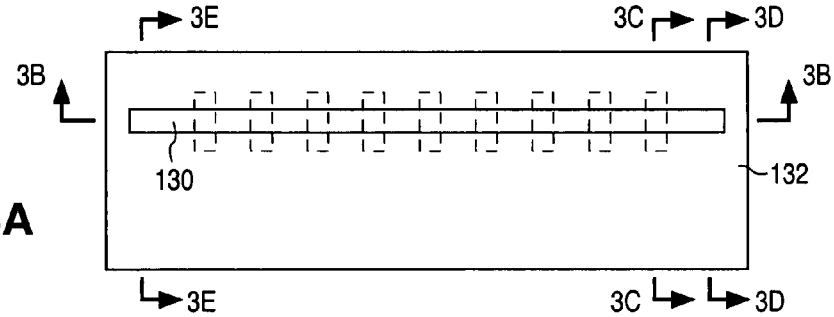
Figure 3B:
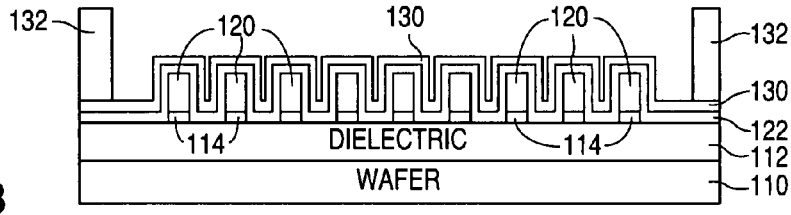
Figure 3C:
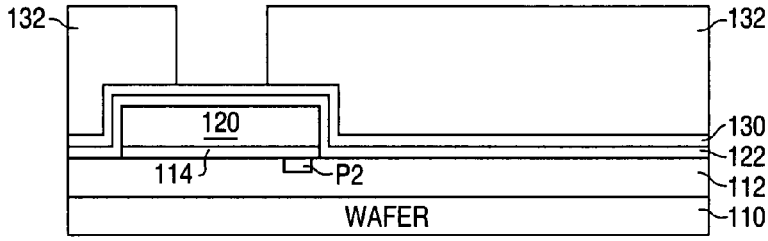
Figure 3D:
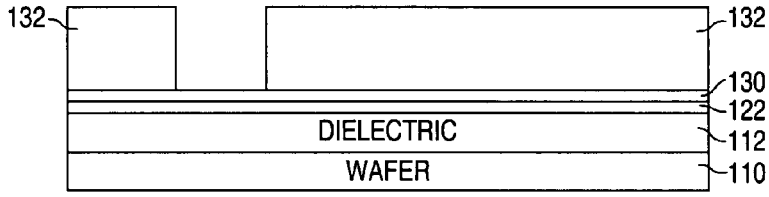
Figure 3E:
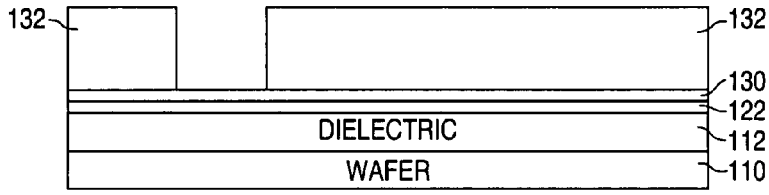
Figure 4A:
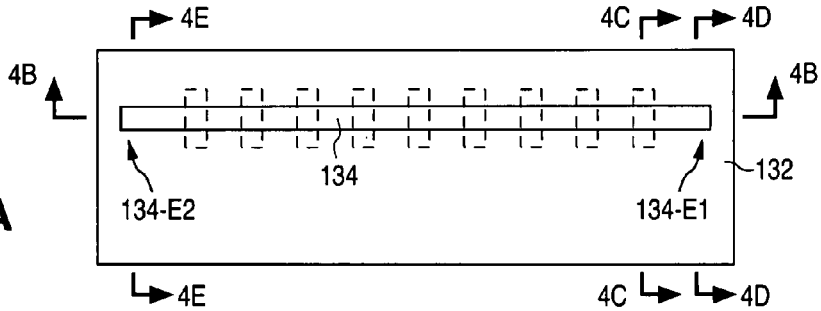
Figure 4B:
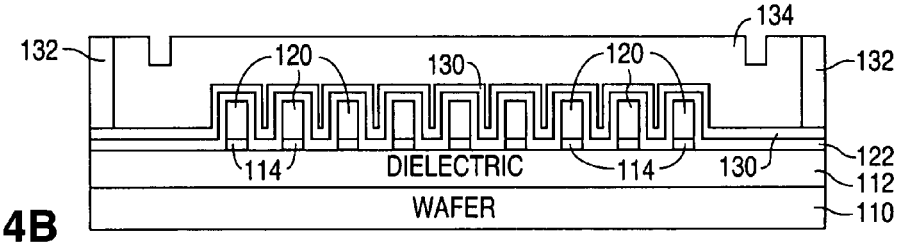
Figure 4C:
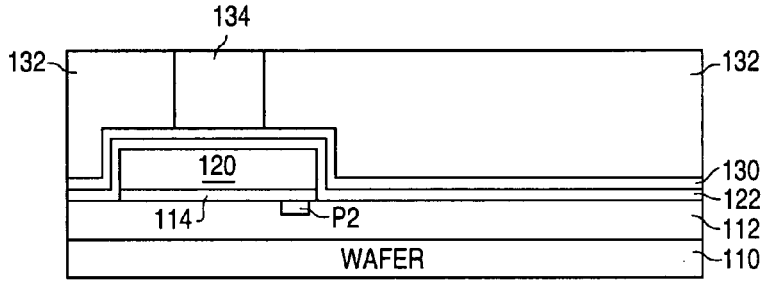
Figure 4D:
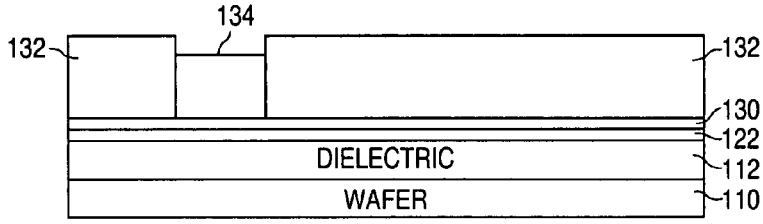
Figure 4E:
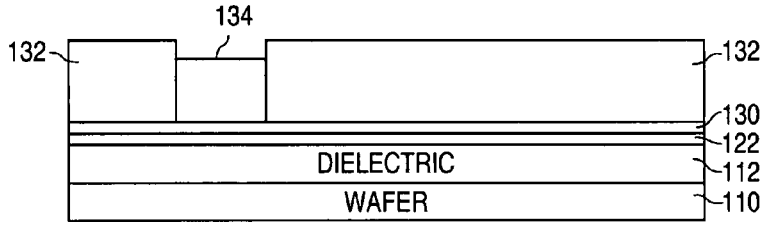
Figure 5A:
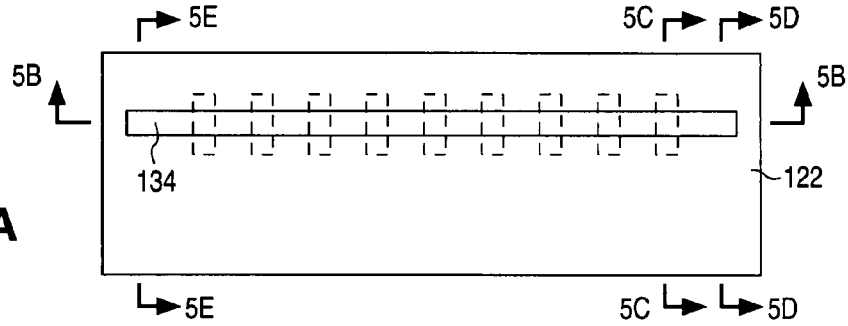
Figure 5B:
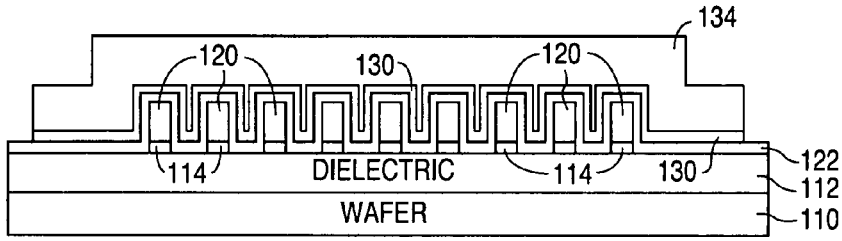
Figure 5C:
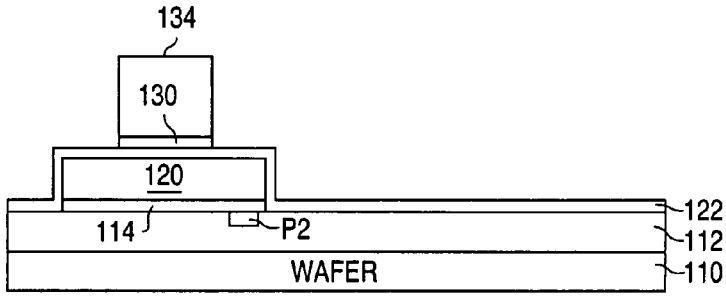
Figure 5D:
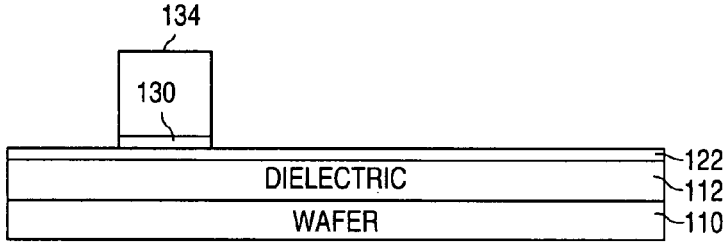
Figure 5E:
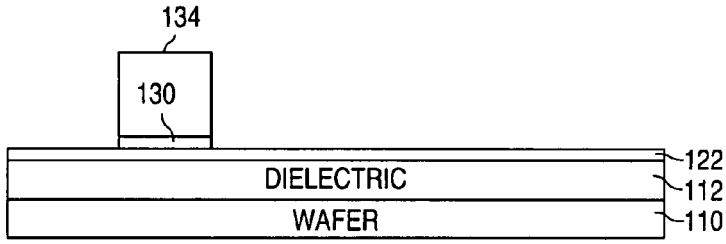
Figure 6A:
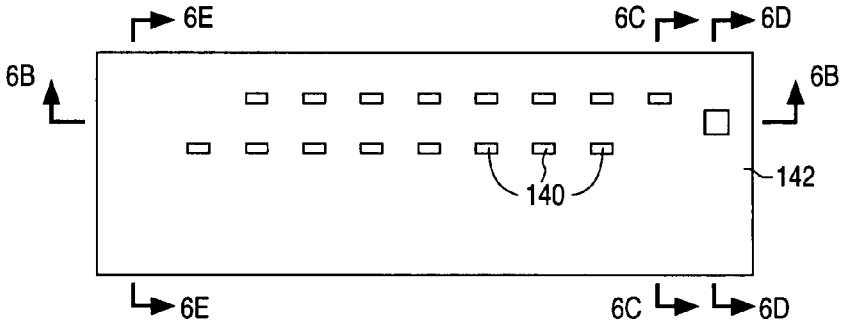
Figure 6B:
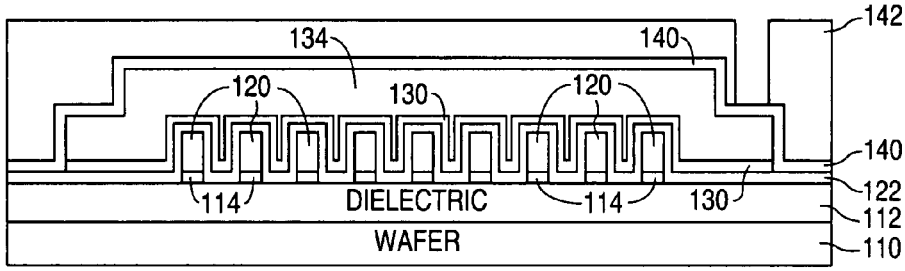
Figure 6C:
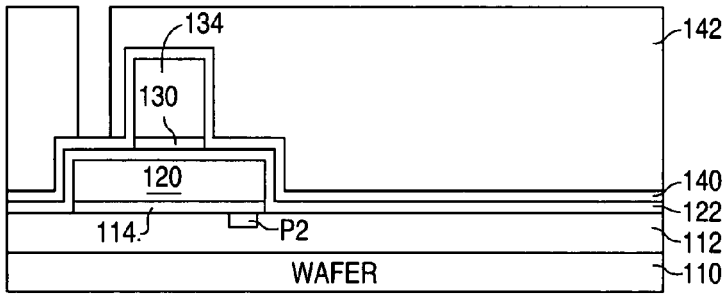
Figure 6D:
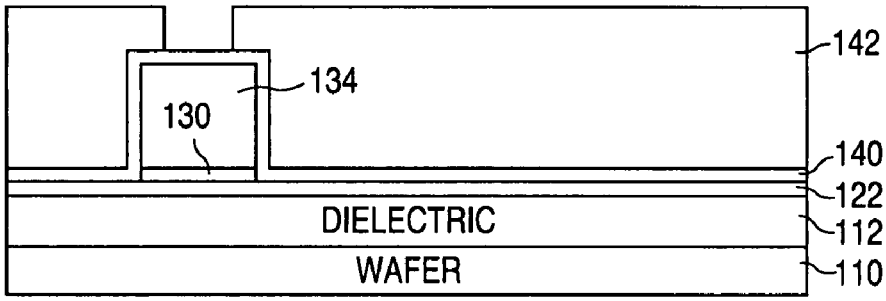
Figure 6E:
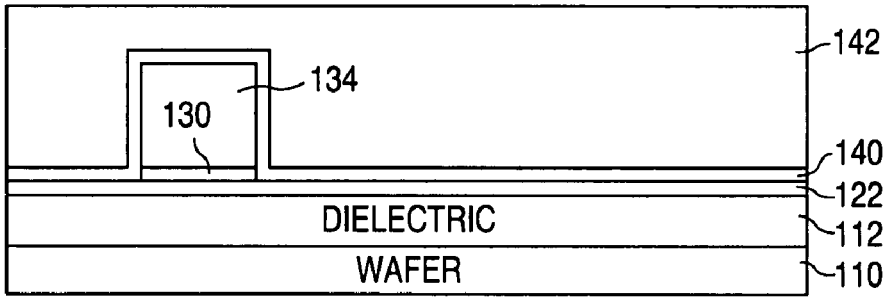
Figure 7A:
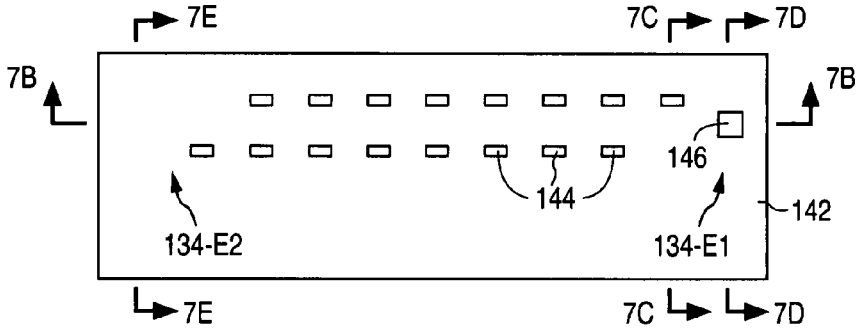
Figure 7B:
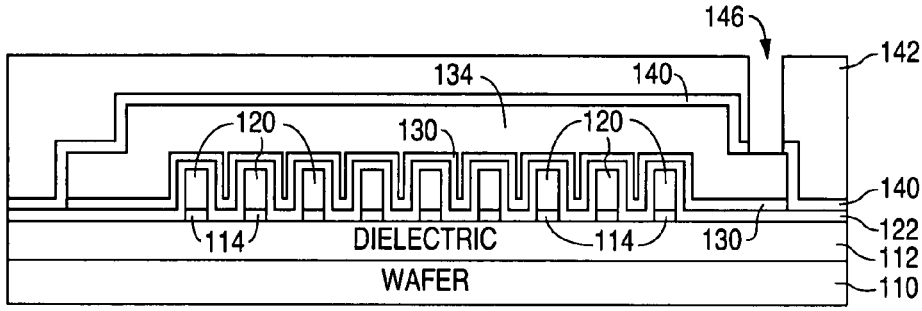
Figure 7C:
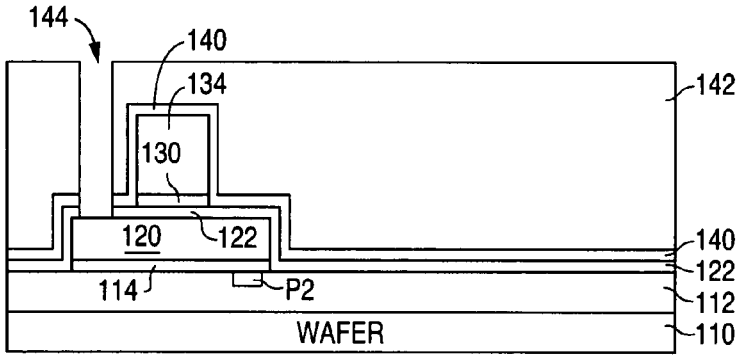
Figure 7D:
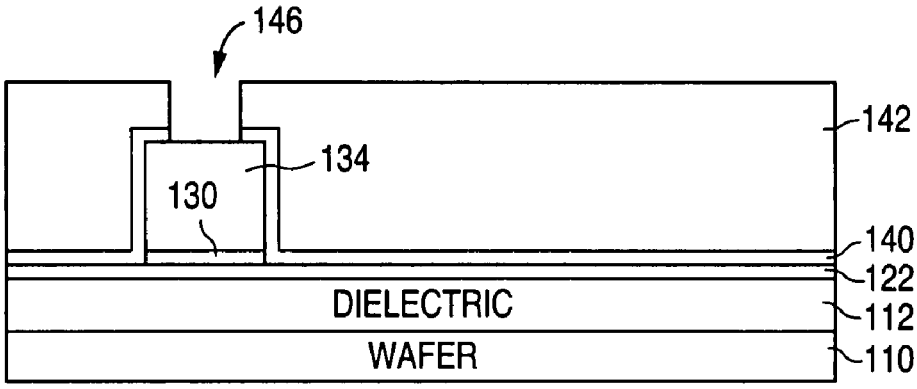
Figure 7E:
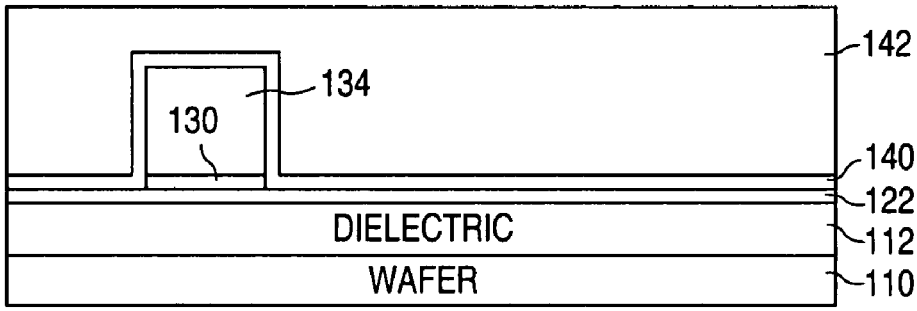
Figure 8A:
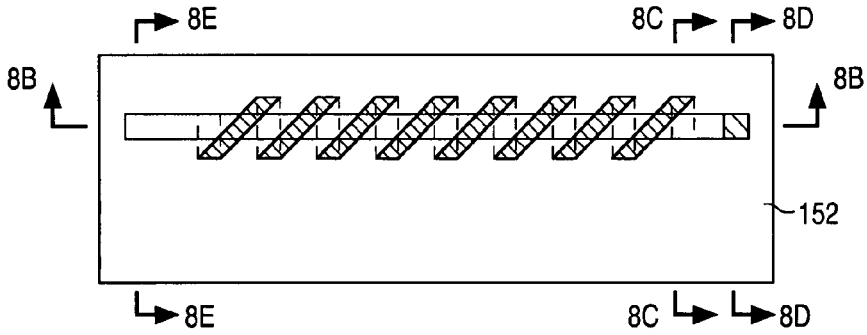
Figure 8B:
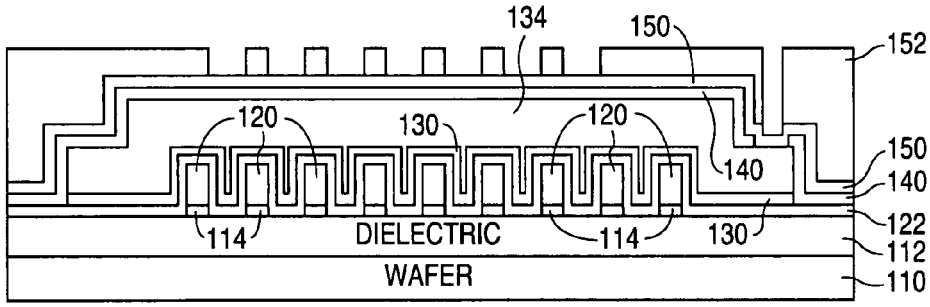
Figure 8C:
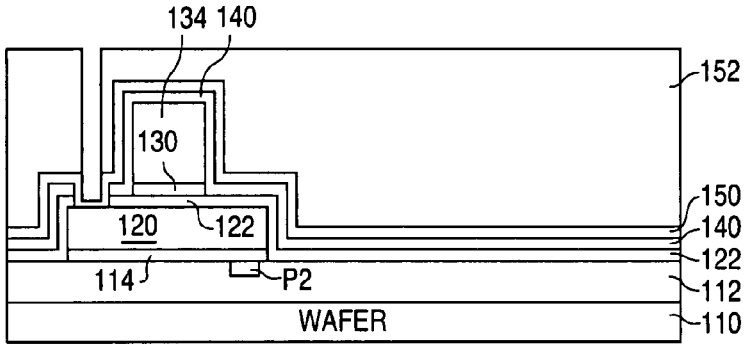
Figure 8D:
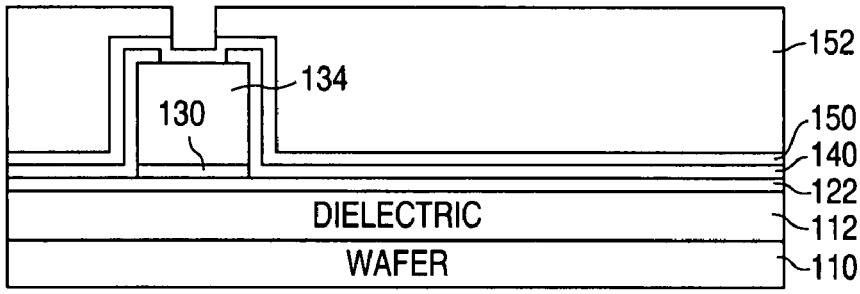
Figure 8E:
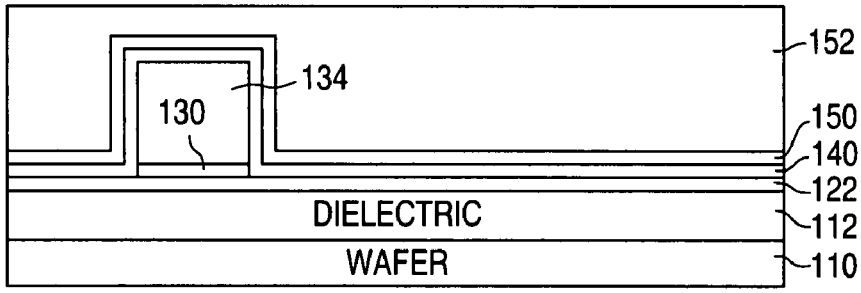
Figure 9A:
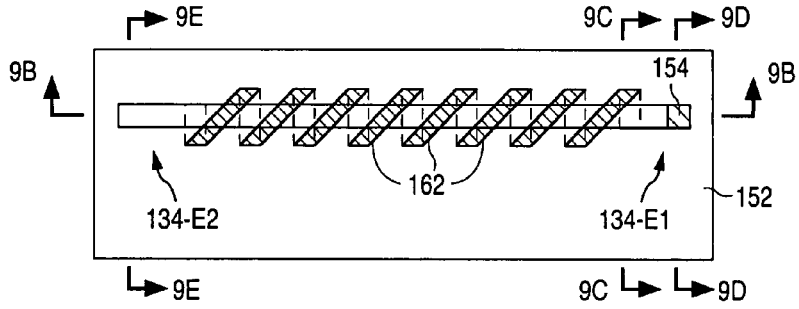
Figure 9B:
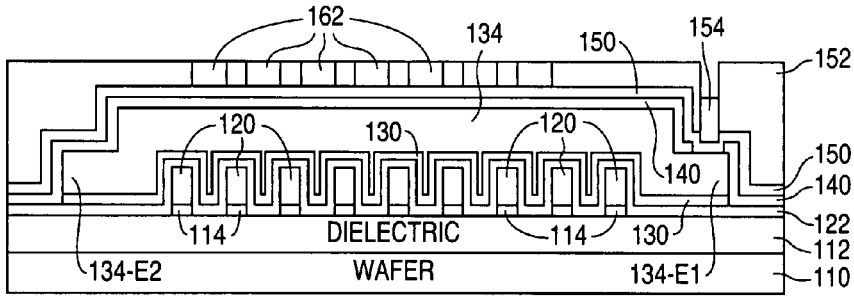
Figure 9C:
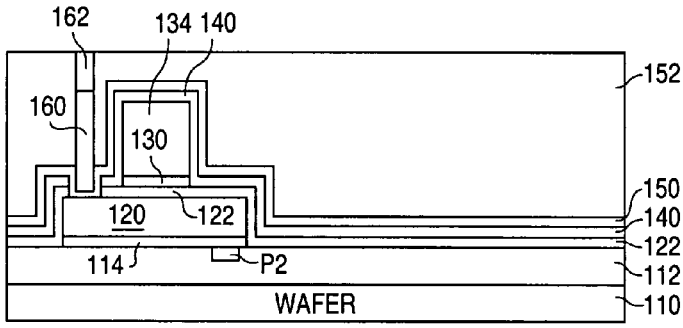
Figure 9D:
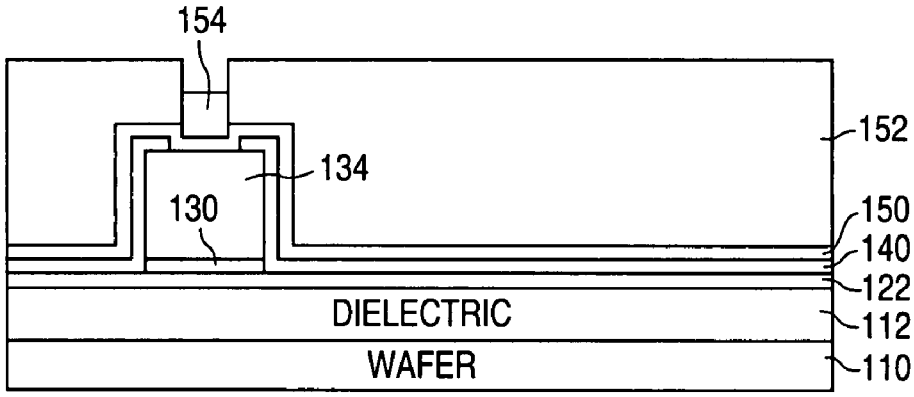
Figure 9E:
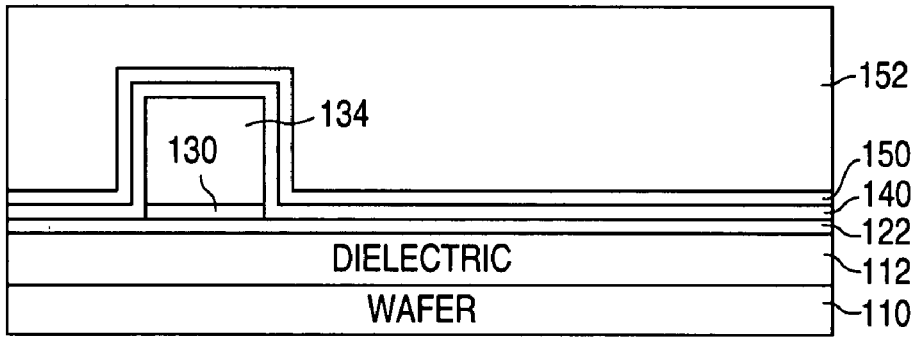
Figure 10A:
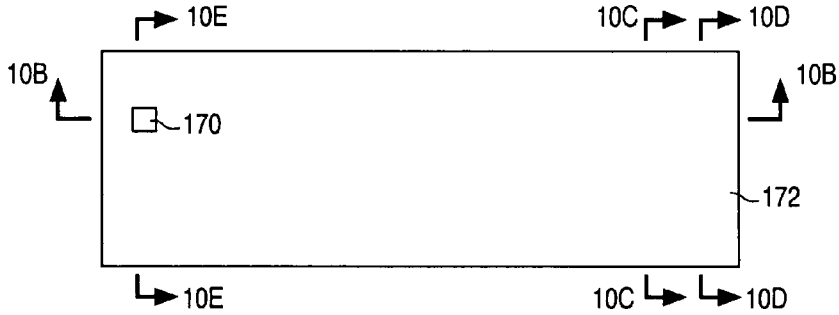
Figure 10B:
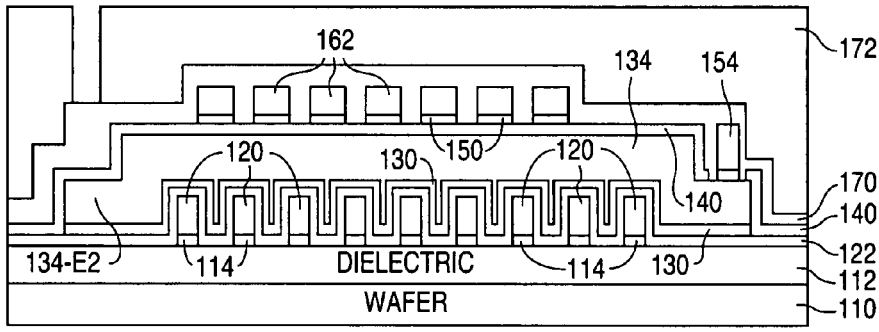
Figure 10C:
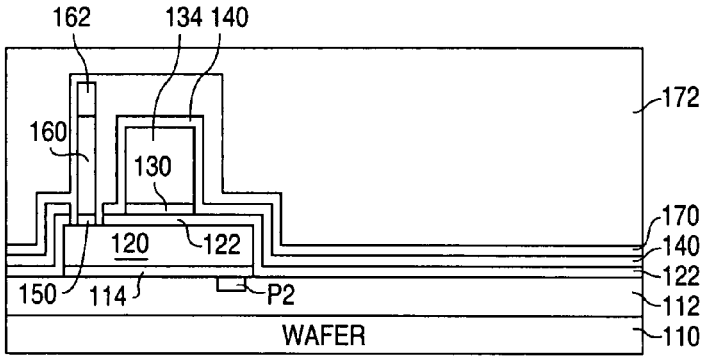
Figure 10D:
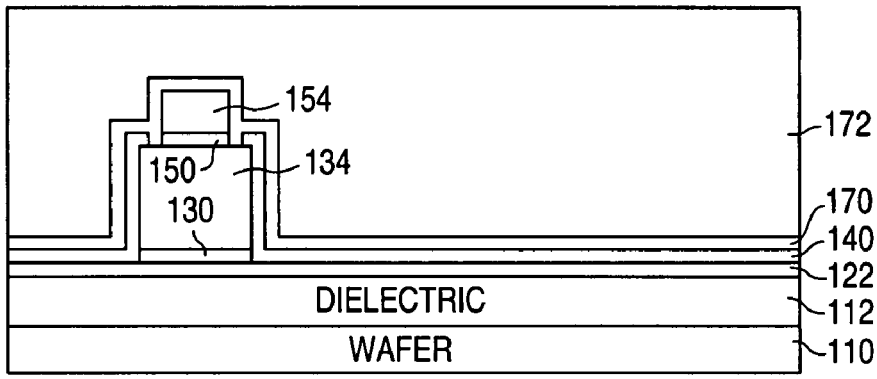
Figure 10E:
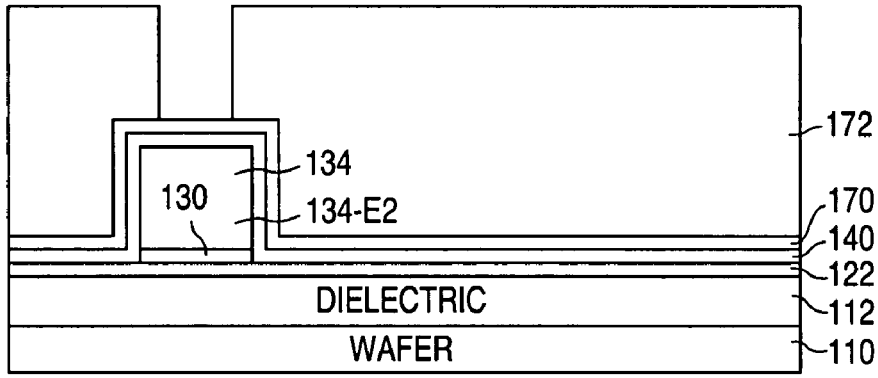
Figure 11A:
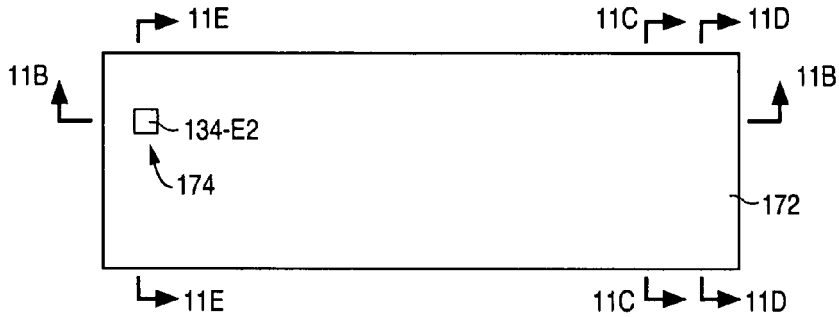
Figure 11B:
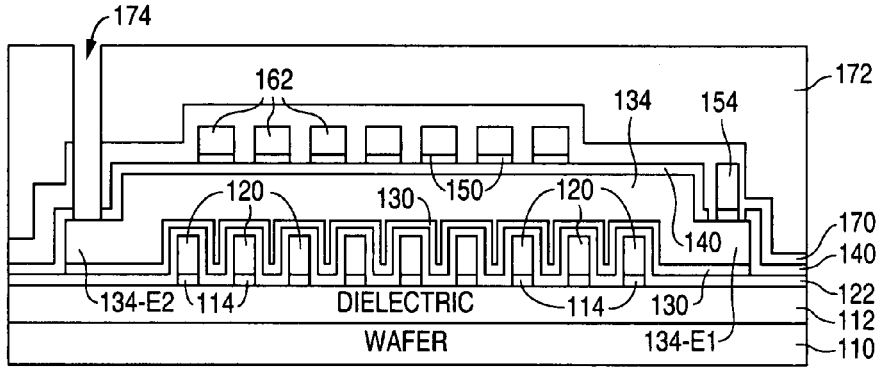
Figure 11C:
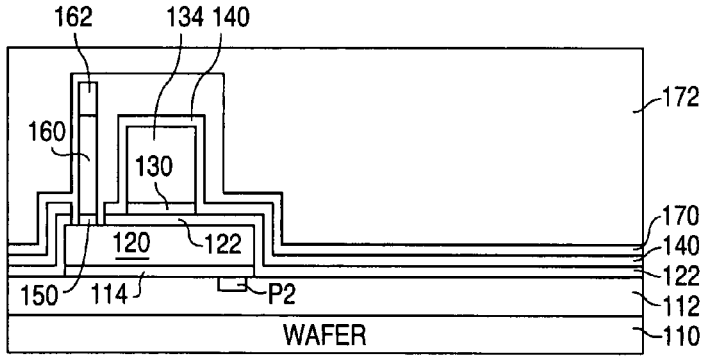
Figure 11D:
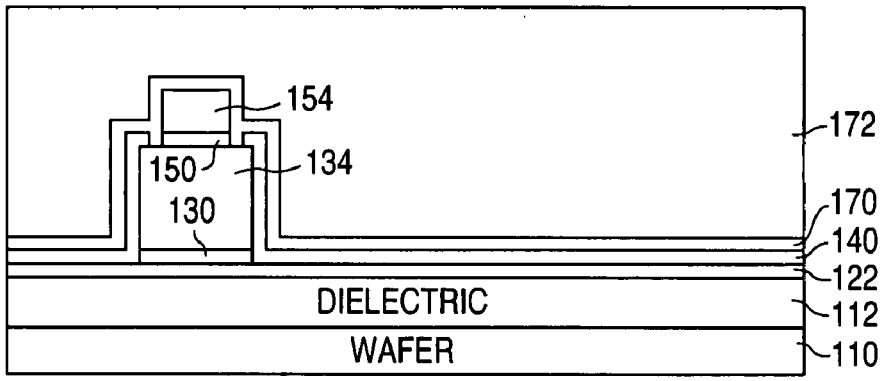
Figure 11E:
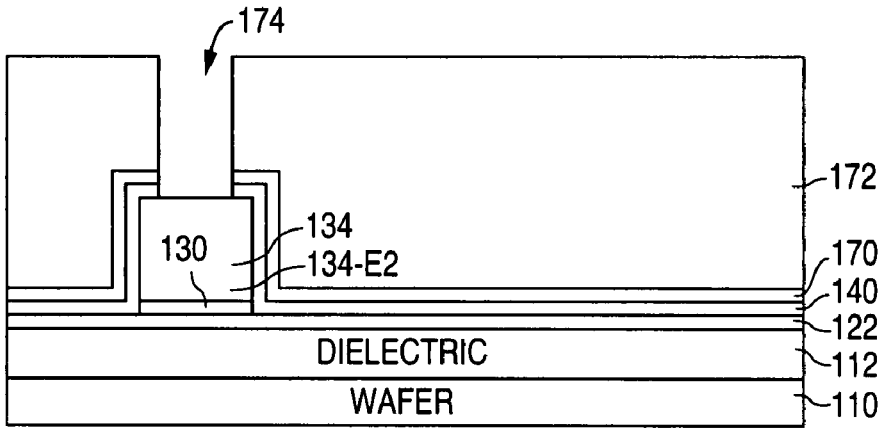
Figure 12A:
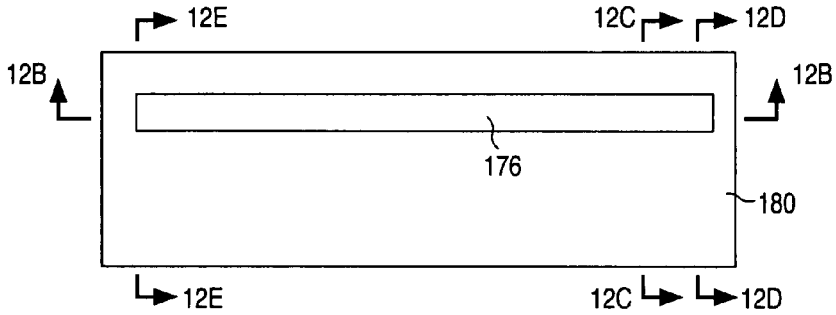
Figure 12B:
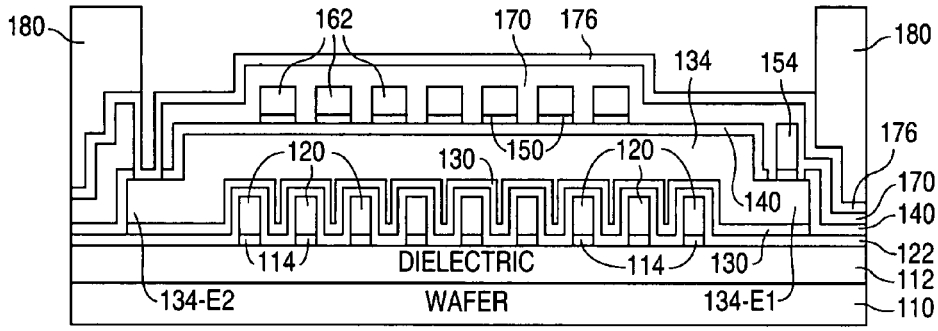
Figure 12C:
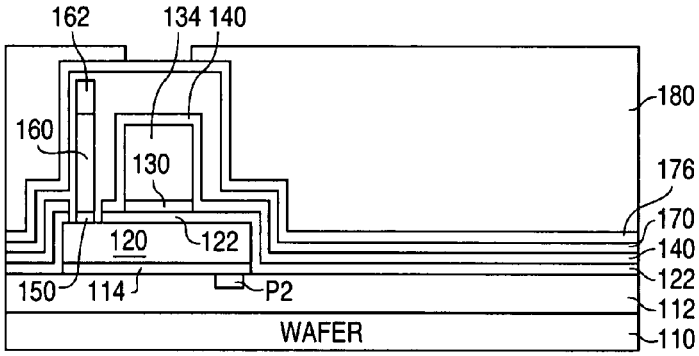
Figure 12D:
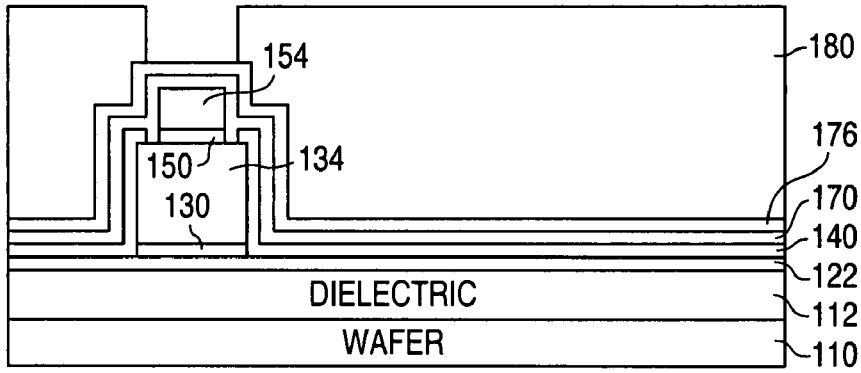
Figure 12E:
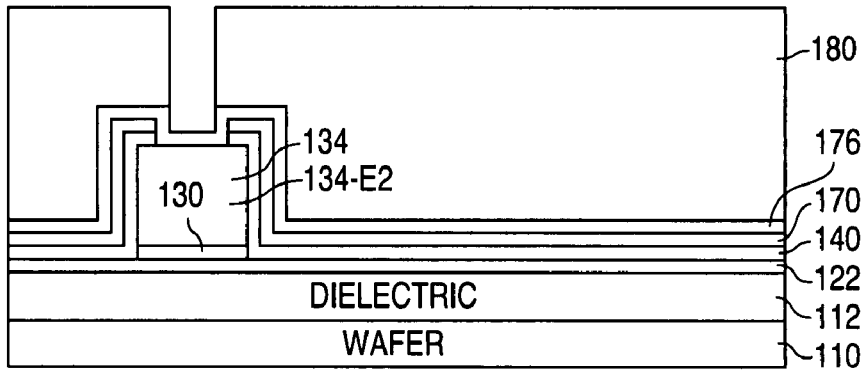
Figure 13A:
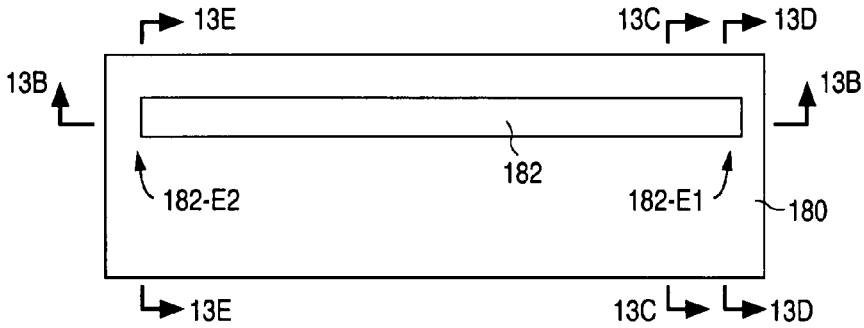
Figure 13B:
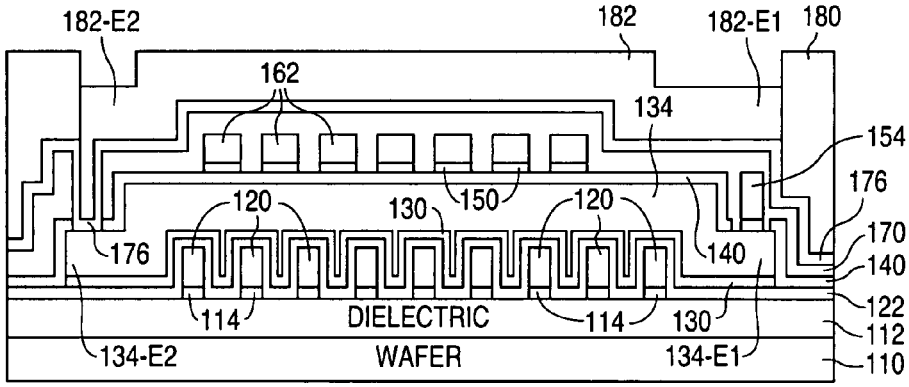
Figure 13C:
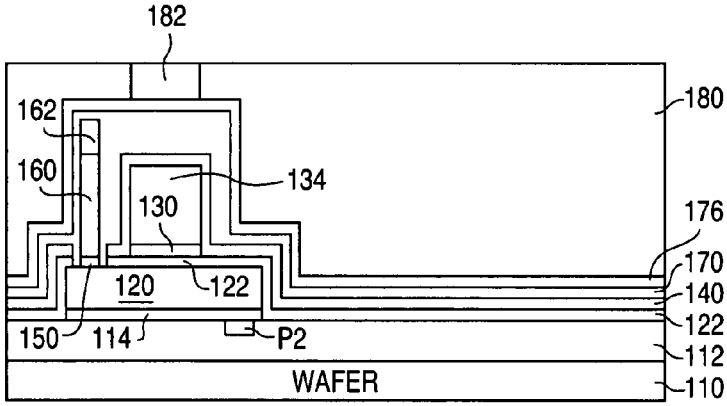
Figure 13D:
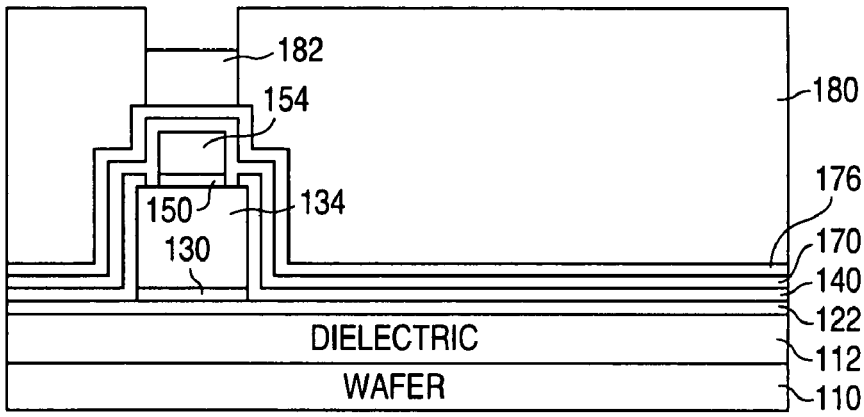
Figure 13E:
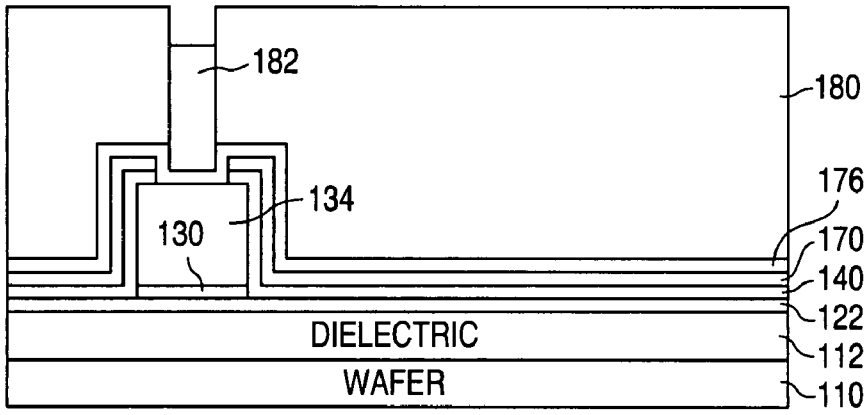

FIGS. 1A-14A, 1B-14B, 1C-14C, 1D-14D, and 1E-14E show a series of views that illustrate a method of forming a MEMS actuator 100 in accordance with the present invention. As shown in FIGS. 1A-1E, the method utilizes a conventionally formed single-crystal silicon semiconductor wafer 110 that has an overlying dielectric layer 112.

Dielectric layer 112 can represent a dielectric layer that includes no metal structures, or a dielectric layer that includes metal structures, such as the dielectric layer of a metal interconnect structure. When formed as the dielectric layer of a metal interconnect structure, dielectric layer 112 includes levels of metal traces, which are typically aluminum, a large number of contacts that connect the bottom metal trace to electrically conductive regions on wafer 110, and a large number of inter-metal vias that connect the metal traces in adjacent layers together. Further, selected regions on the top surfaces of the metal traces in the top metal layer function as pads which provide external connection points.

In the present example, dielectric layer 112 represents the dielectric layer of a metal interconnect structure that also includes pads P1 and P2. Pads P1 and P2 are selected regions on the top surfaces of two of the metal traces in the top layer of metal traces that provide electrical connections for a to-be-formed square coil. (Only pad P2, and not the entire metal interconnect structure, is shown in cross-section in FIGS. 1C-11C for clarity.)

Referring again to FIGS. 1A-1E, the method begins by forming a seed layer 114 on the top surface of dielectric layer 112. In the present example, since dielectric layer 112 represents the dielectric layer of a metal interconnect structure, seed layer 114 is also formed on the pads P1 and P2.

Seed layer 114 typically includes a layer of titanium (e.g., 300 Å thick) and an overlying layer of copper (e.g., 3000 Å thick). The titanium layer enhances the adhesion between the aluminum in the underlying metal traces and the overlying layer of copper. Once seed layer 114 has been formed, a mask 116, such as a layer of photoresist, is formed and patterned on the top surface of seed layer 114.

As shown in FIGS. 2A-2E, following the formation and patterning of mask 116, copper is deposited by electroplating to form a number of spaced-apart copper lower sections 120. The copper lower sections 120 form the lower sides of the to-be-formed square coil. Since dielectric layer 112 represents the dielectric layer of a metal interconnect structure in the present example, the ends of the copper lower sections 120 that correspond with the opposite ends of the square coil are electrically connected to pads P1 and P2. After the copper lower sections 120 have been formed, mask 116 is removed, followed by the removal of the underlying regions of seed layer 114.

Next, as shown in FIGS. 3A-3E, a dielectric layer 122, such as an oxide layer, is conformally deposited on dielectric layer 112 and the copper lower sections 120. Once dielectric layer 122 has been formed, a seed layer 130 is formed on the top surface of dielectric layer 122. After seed layer 130 has been formed, a mask 132, such as a layer of photoresist, is formed and patterned on the top surface of seed layer 130.

Following the formation and patterning of mask 132, as shown in FIGS. 4A-4E, a magnetic material, such as an alloy of nickel and iron like permalloy, is deposited by electroplating to form a core member 134. Thus, the thickness of mask 132 determines the thickness of core member 134. In the present example, core member 134 has a height on the order of 25 μm, a width on the order of 30 μm, and a length on the order of 750 μm.

In addition, core member 134 has a first end 134-E1 and an opposite second end 134-E2 that lie outside of the two outer copper lower sections 120. Once core member 134 has been formed, as shown in FIGS. 5A-5E, mask 132 and the underlying regions of seed layer 130 are removed.

Next, as shown in FIGS. 6A-6E, a dielectric layer 140, such as a plasma oxide layer, is conformally deposited on dielectric layer 122 and core member 134. Typical processing temperatures for a plasma oxide layer do not exceed 400° C. After dielectric layer 140 has been formed, a mask 142, such as a layer of photoresist, is then formed and patterned on the top surface of dielectric layer 140.

Following the formation and patterning of mask 142, as shown in FIGS. 7A-7E, the exposed regions of dielectric layer 140 and underlying dielectric layer 122 (where present) are etched to form vertical openings 144 that expose the top surfaces of the ends of the copper lower sections 120 that form the lower sides of the to-be-formed square coil. In addition, the etch can optionally form a vertical opening 146 that exposes the first end 134-E1 of core member 134. Mask 142 is then removed.

Once mask 142 has been removed, as shown in FIGS. 8A-8E, a seed layer 150 is formed on the exposed ends of the copper lower sections 120, the first end 134-E1 of core member 134, if exposed, and the top surface of dielectric layer 140. After seed layer 150 has been formed, a mask 152, such as a layer of photoresist, is formed and patterned on the top surface of seed layer 150. The pattern (openings) in mask 152 is shown hatched in FIG. 8A.

Next, as shown in FIGS. 9A-9E, following the formation and patterning of mask 152, copper is deposited by electroplating to form a copper pedestal 154 that touches the first end 134-E1 of core member 134 if optional vertical opening 146 was formed, a number of copper side sections 160 of the square coil, and a number of copper upper sections 162 of the square coil. Copper pedestal 154 and the copper upper sections 162 of the square coil are shown hatched in FIG. 9A. Following this, mask 152 and the underlying regions of seed layer 150 are removed.

As shown in FIGS. 10A-10E, after seed layer 150 has been removed, a sacrificial layer 170 is conformally deposited on dielectric layer 140, copper pedestal 154, if formed, and the copper upper sections 162. The thickness of sacrificial layer 170 determines the size of the actuation gap. Once sacrificial layer 170 has been formed, an opening is formed in sacrificial layer 170 to expose the top surface of the second end 134-E2 of core member 134.

Sacrificial layer 170 can be formed from a number of materials. For example, a thin sacrificial layer with accurate dimensions (on the order of 2 μm) can be formed by utilizing a layer of oxide. If an oxide sacrificial layer is used, the layer of oxide must be masked and etched to form the opening in sacrificial layer 170 and an opening in underlying dielectric layer 140 to expose the top surface of the second end 134-E2 of core member 134.

As shown in FIGS. 10A-10E, when an oxide sacrificial layer is used, a mask 172, such as a layer of photoresist, is formed and patterned on the top surface of sacrificial layer 170. Following the formation and patterning of mask 172, as shown in FIGS. 11A-11E, the exposed regions of sacrificial layer 170 and the underlying regions of dielectric layer 140 are etched to form a vertical opening 174 that exposes the top surface of the second end 134-E2 of core member 134. Mask 172 is then removed.

On the other hand, a thicker sacrificial layer with less accurate dimensions (on the order of 10 μm) can be formed by utilizing a layer of photoresist. When a photoresist sacrificial layer is used, vertical opening 174 can be formed by patterning sacrificial layer 170 using conventional photolithographic processes. Once patterned, the exposed regions of dielectric layer 140 are etched to expose the top surface of the second end 134-E2 of core member 134.

Once vertical opening 174 has been formed in sacrificial layer 170, as shown in FIGS. 12A-12E, a seed layer 176 is formed on sacrificial layer 170 and the exposed top surface of the exposed second end 134-E2 of core member 134. After seed layer 176 has been formed, a mask 180, such as a layer of photoresist, is formed and patterned on the top surface of seed layer 176.

Following the formation and patterning of mask 180, as shown in FIGS. 13A-13E, a magnetic material, such as an alloy of nickel and iron like permalloy, is deposited by electroplating to form a flexible member 182. Flexible member 182 has a floating end 182-E1, and an opposite stationary end 182-E2 that is connected to the top surface of the second end 134-E2 of core member 134.

Once flexible member 182 has been formed, as shown in FIGS. 14A-14E, mask 180, the underlying regions of seed layer 176, and sacrificial layer 170 are removed. (When a photoresist sacrificial layer 170 is used, seed layer 176 lifts off with the removal of photoresist layers 170 and 180.)

The removal of mask 180, the underlying regions of seed layer 176, and sacrificial layer 170 releases flexible member 182, which completes the formation of actuator 100. As a result, the floating end 182-E1 of flexible member 182 can move vertically towards and away from copper pedestal 154 (or the first end 134-E1 of core member 134 if pedestal 154 was omitted).

Thus, a method of forming actuator 100 has been described. As shown in FIGS. 14A-14E, actuator 100 has a square coil 184 that lies on dielectric layer 112. In the present example, coil 184 is formed by connecting together the copper lower sections 120, the copper side sections 160, and the copper upper sections 162.

Actuator 100 also has a core member 134 that lies within, and is isolated from, coil 184. Core member 134 has a first end 134-E1 and an opposite second end 134-E2 that lie outside of coil 184. In addition, core member 134 is isolated from coil 184 by dielectric layer 122 and dielectric layer 140. Further, core member 134 is implemented with a magnetic material, such as an alloy of nickel and iron like permalloy.

Actuator 100 additionally has a flexible member 182. Flexible member 182, which has a floating end 182-E1 and a stationary end 182-E2, lies directly vertically over core member 134. Stationary end 182-E2 is directly connected to core member 134, while floating end 182-E1 is vertically spaced apart from the top surface of pedestal 154 (or the first end 134-E1 of core member 134 if pedestal 154 is omitted) by an actuation gap 186. In addition, floating end 182-E1 is moveable towards and away from the first end 134-E1 of core member 134. Flexible member 182 is implemented with a magnetic material, such as an alloy of nickel and iron like permalloy.

Figure 14A:
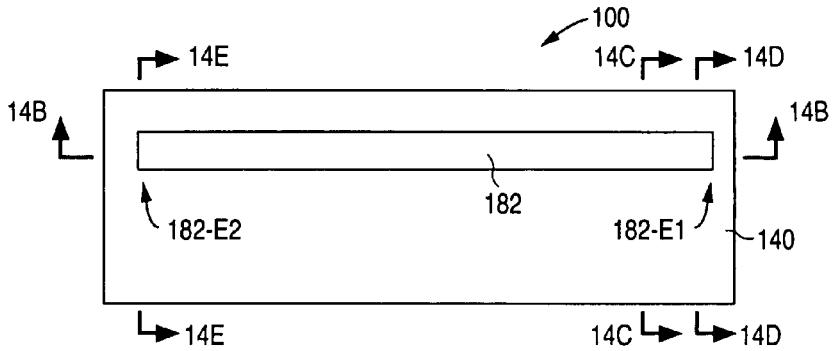
Figure 14B:
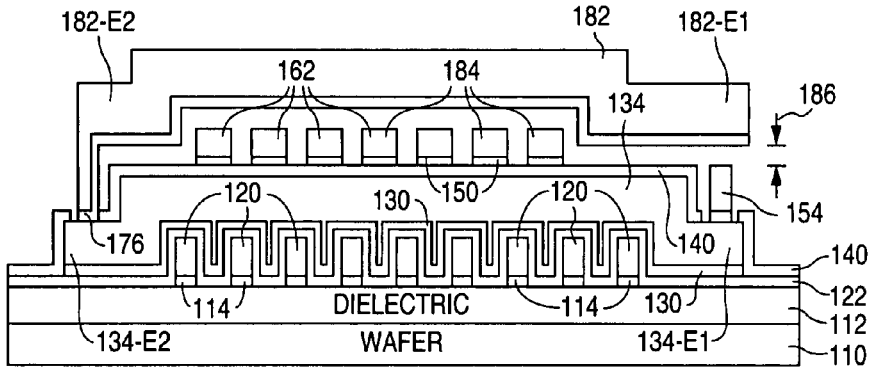
Figure 14C:
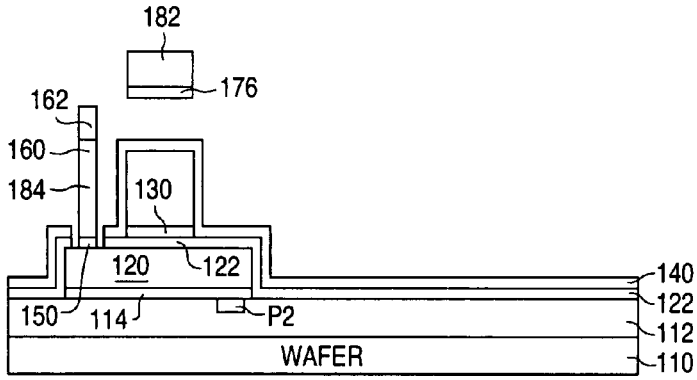
Figure 14D:
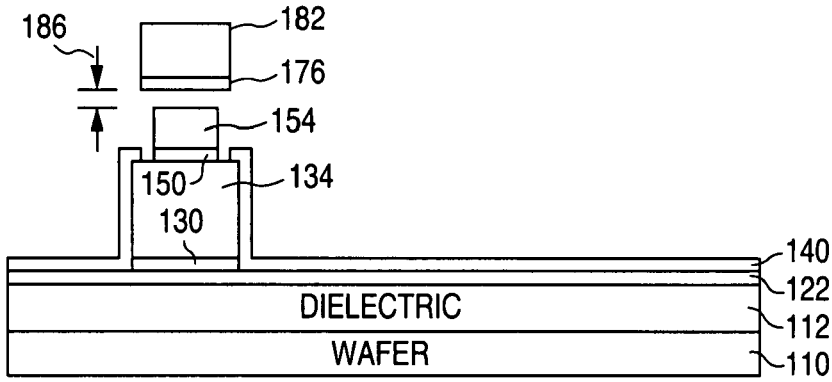
Figure 14E:
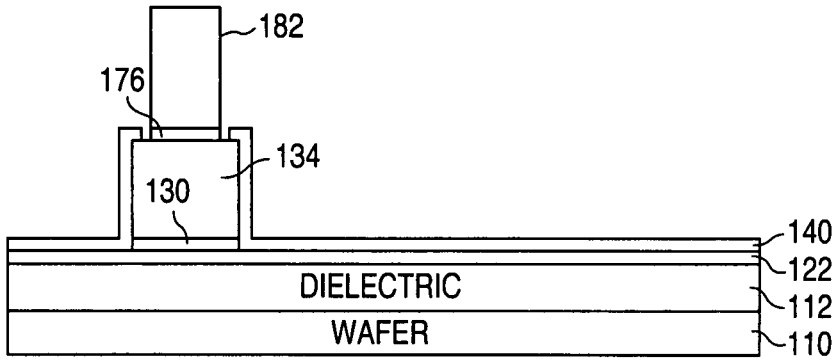
Figure 15A:
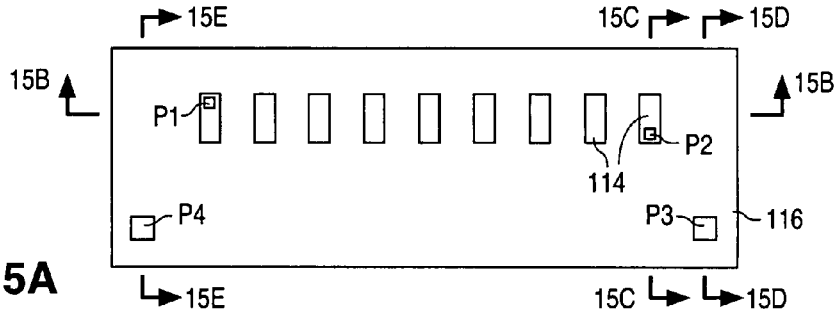
Figure 15B:
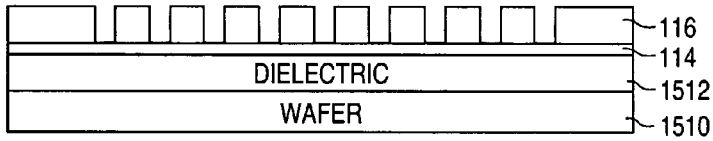
Figure 15C:
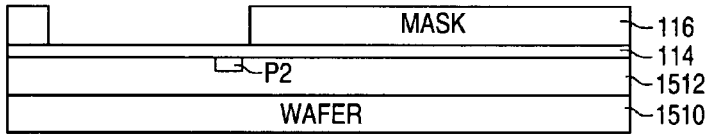
Figure 15D:
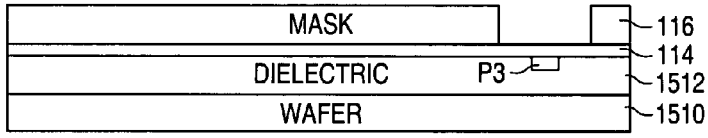
Figure 15E:
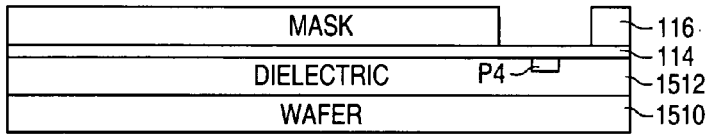
Figure 16A:
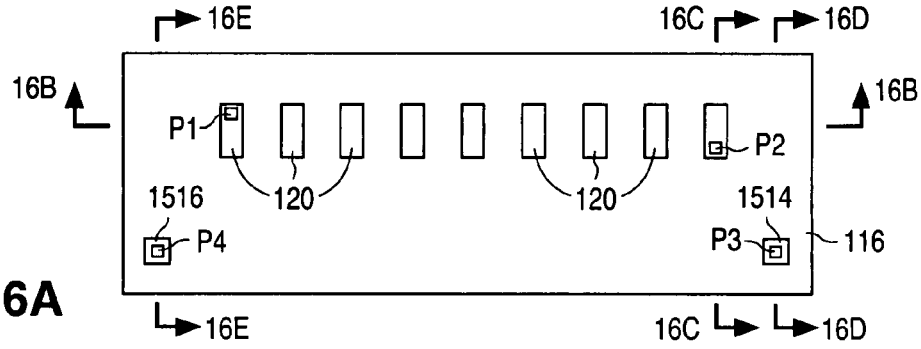
Figure 16B:
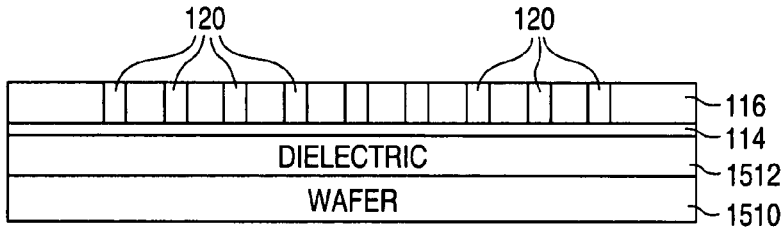
Figure 16C:
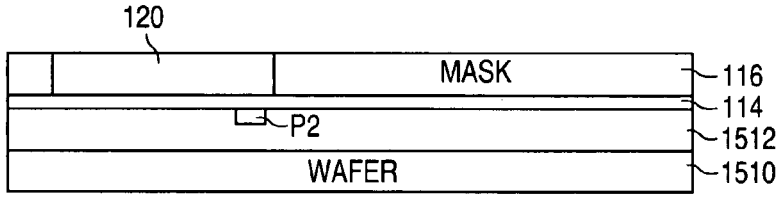
Figure 16D:
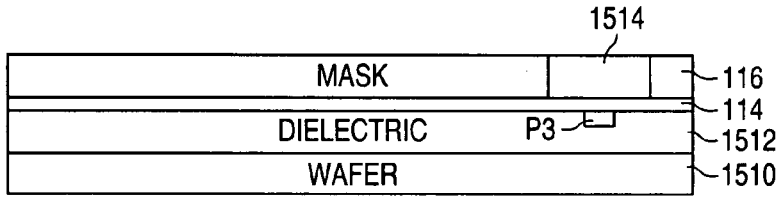
Figure 16E:
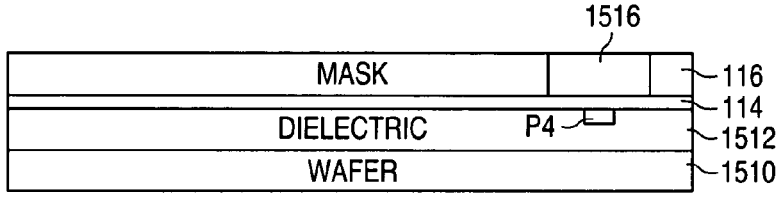
Figure 17A:
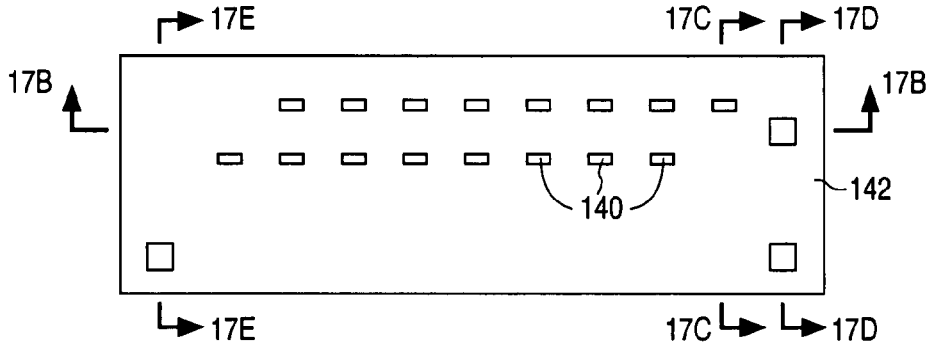
Figure 17B:
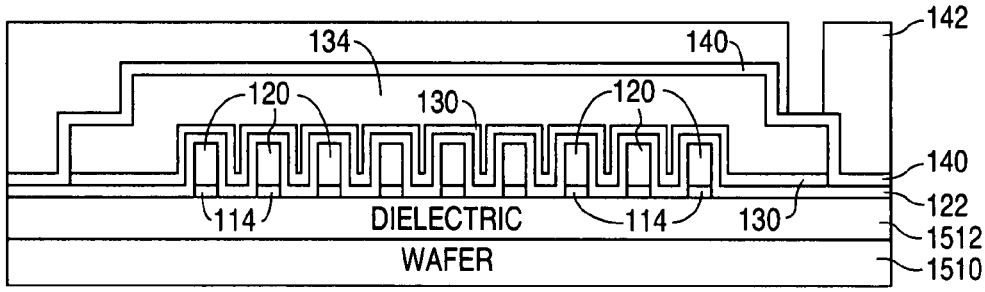
Figure 17C:
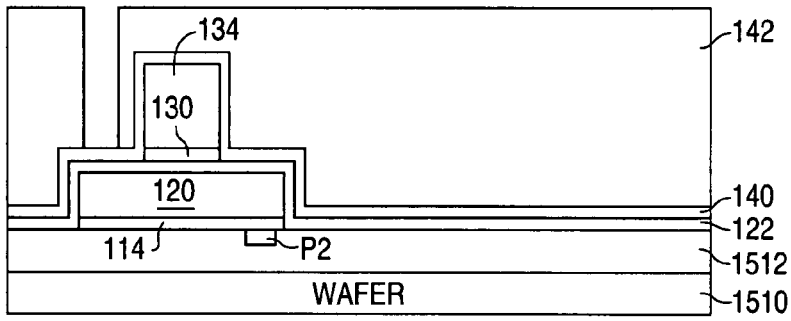
Figure 17D:
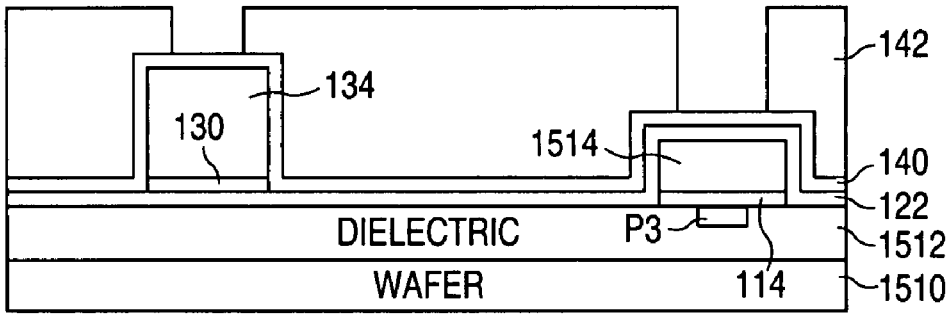
Figure 17E:
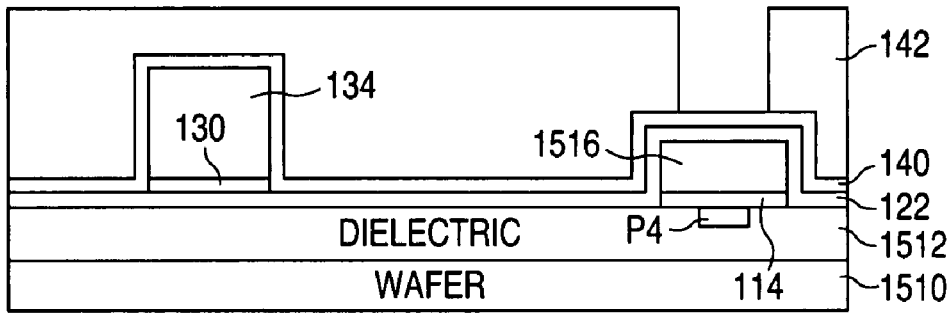
Figure 18A:
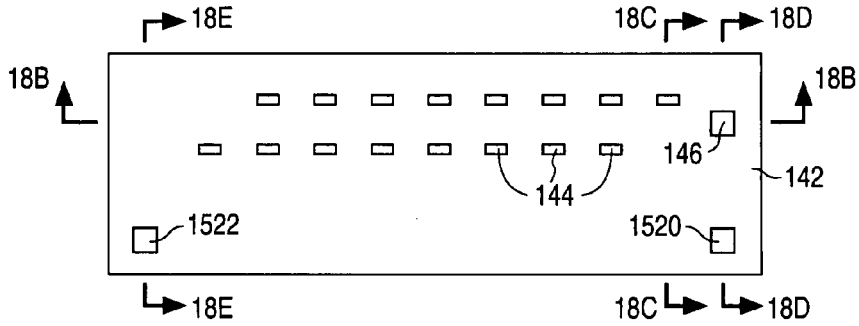
Figure 18B:
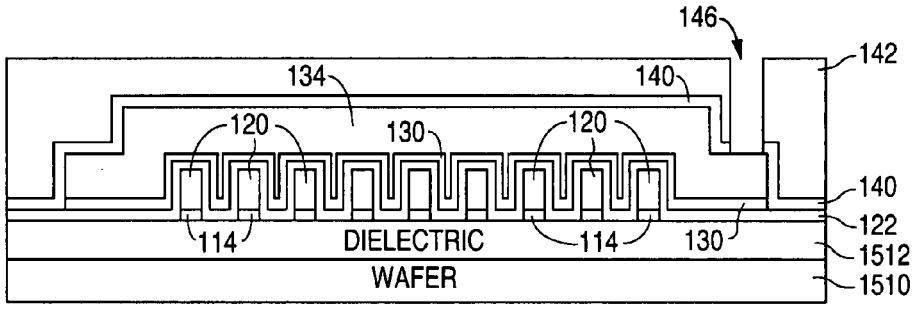
Figure 18C:
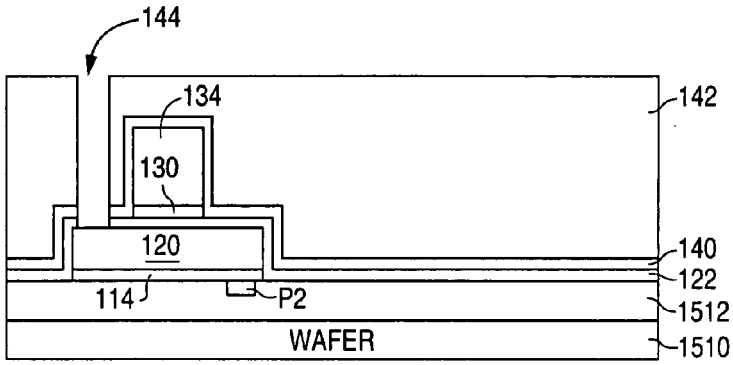
Figure 18D:
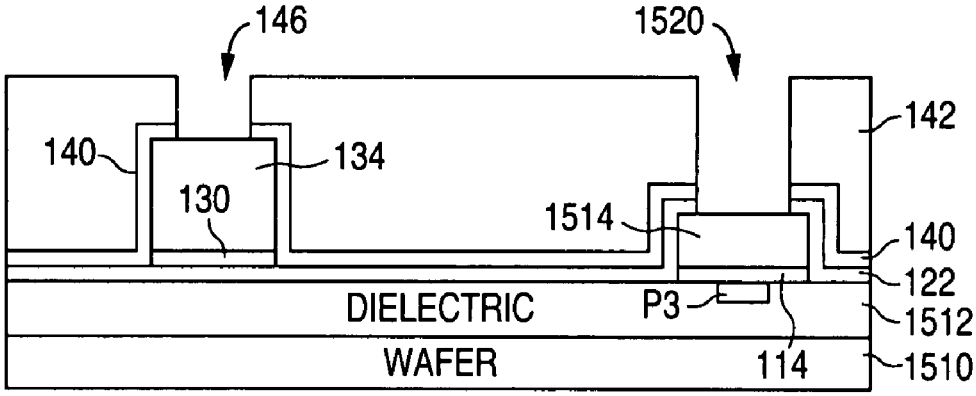
Figure 18E:
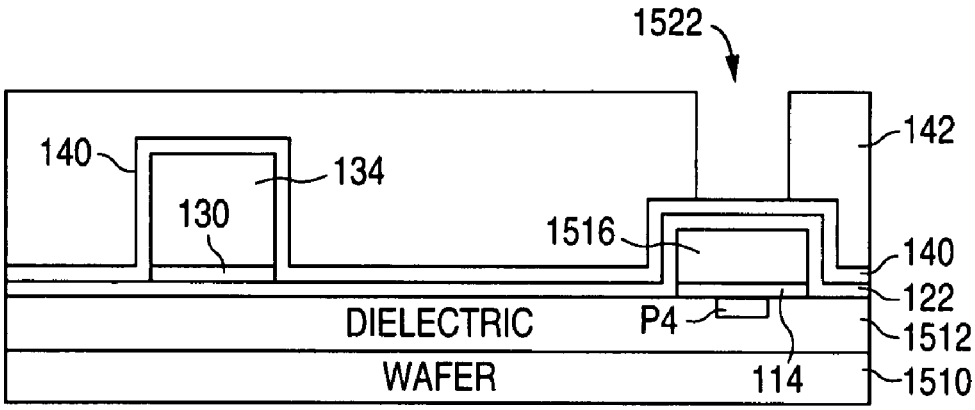
Figure 19A:
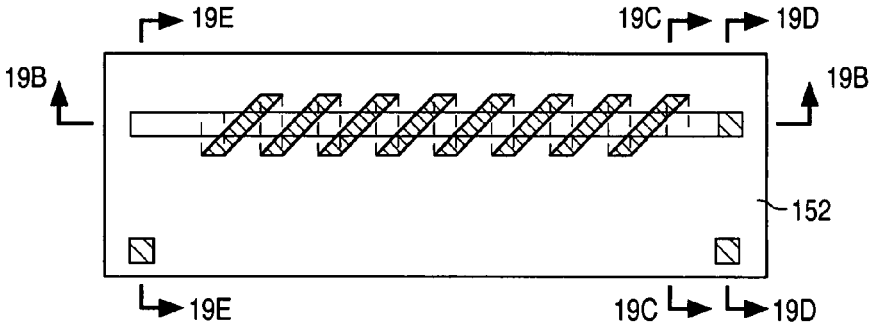
Figure 19B:
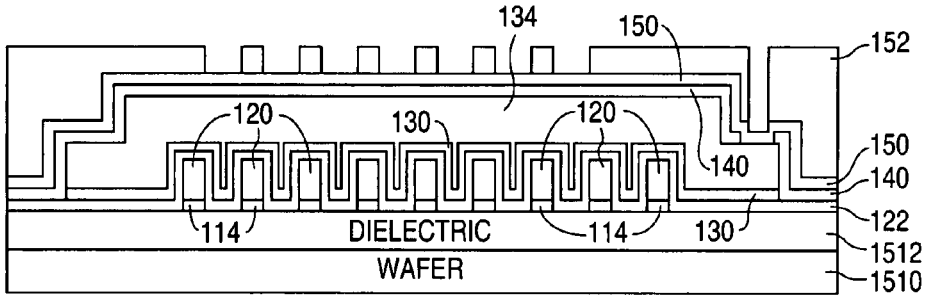
Figure 19C:
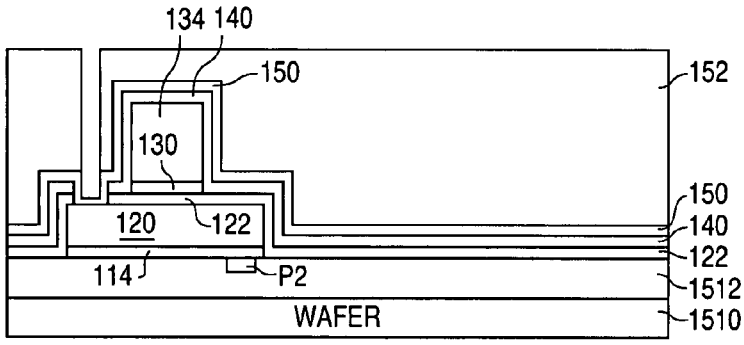
Figure 19D:
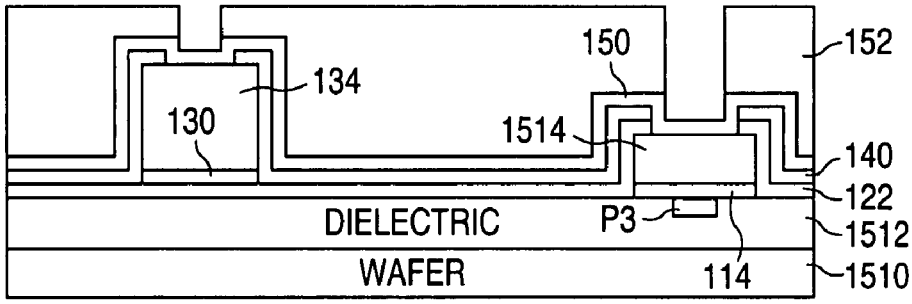
Figure 19E:
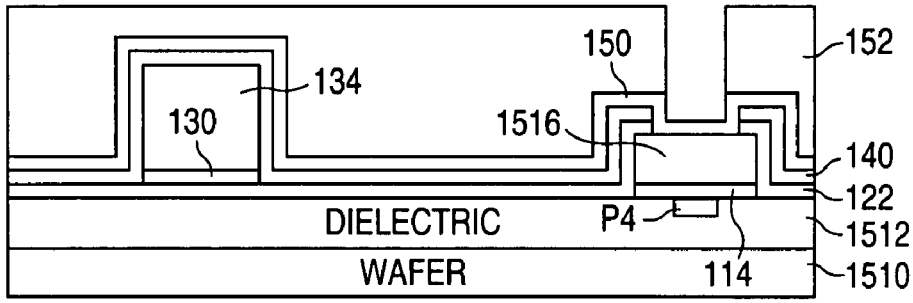
Figure 20A:
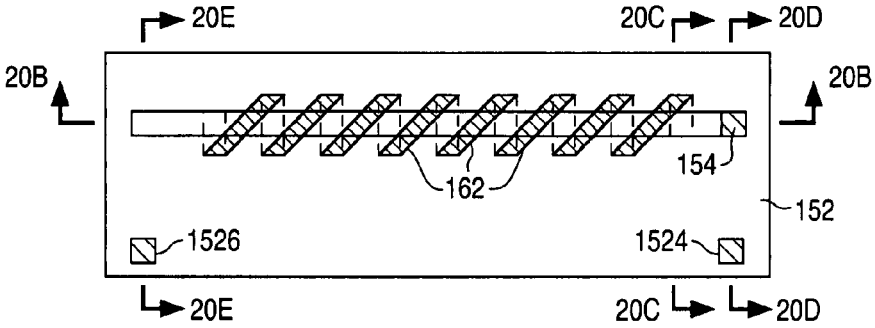
Figure 20B:
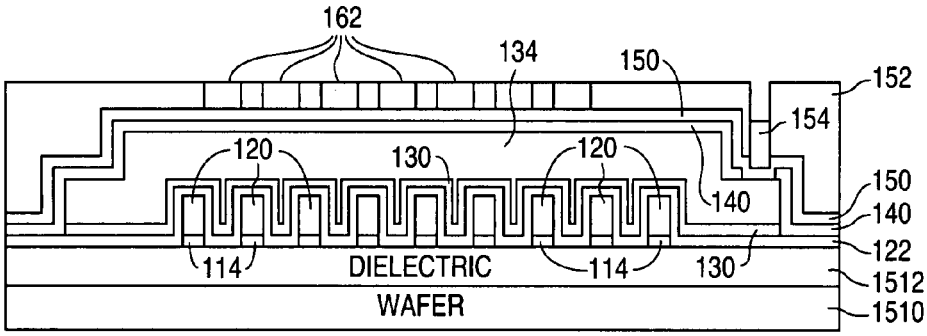
Figure 20C:
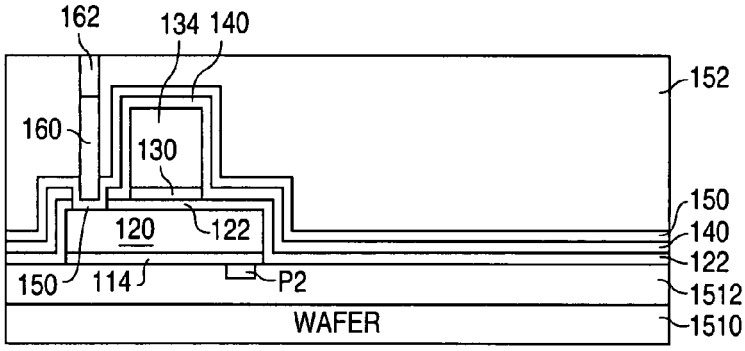
Figure 20D:
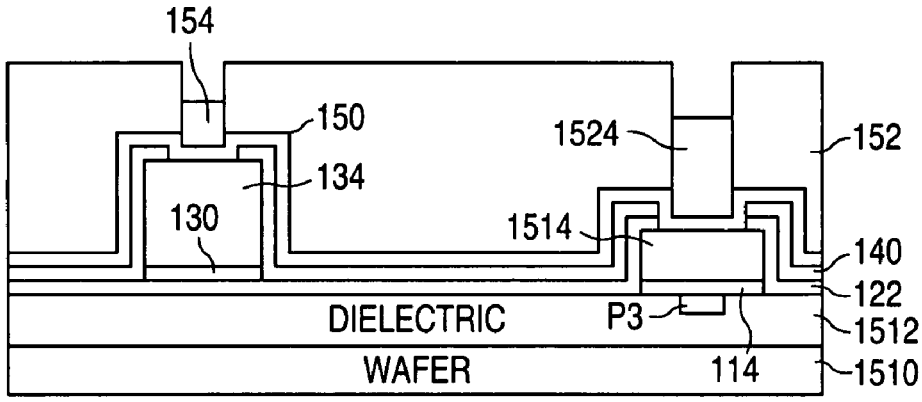
Figure 20E:
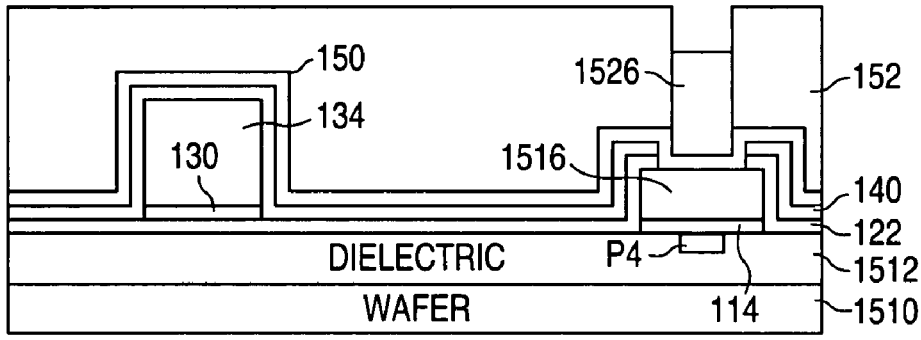
Figure 21A:
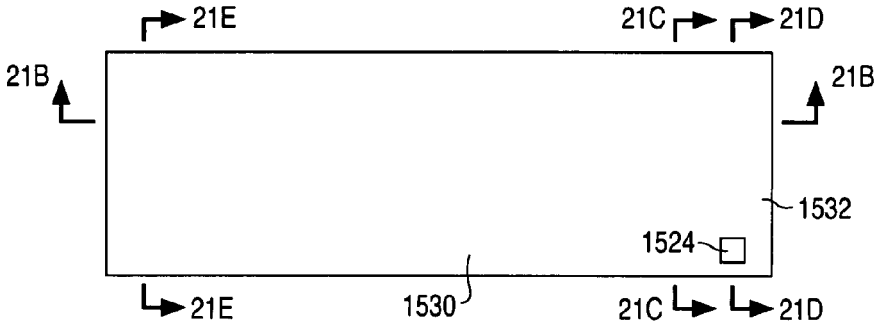
Figure 21B:
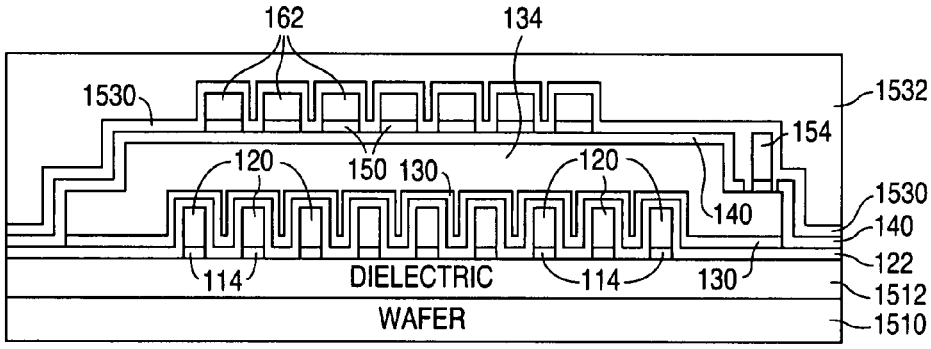
Figure 21C:
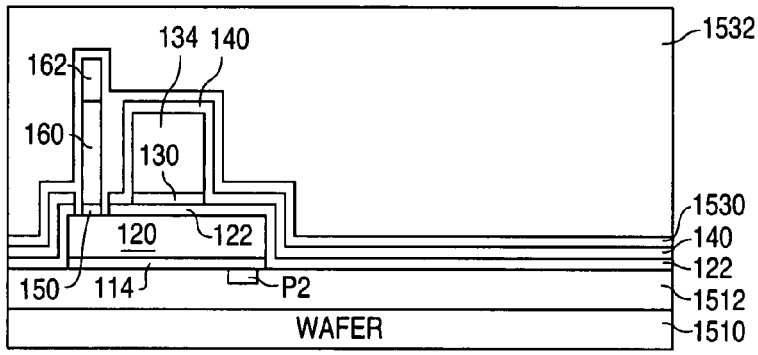
Figure 21D:
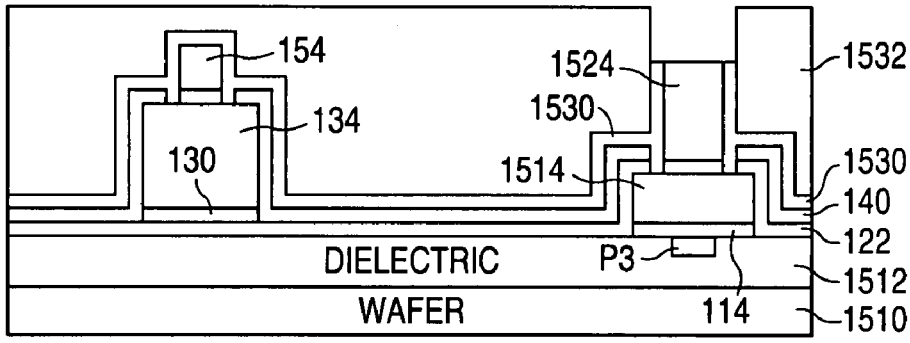
Figure 21E:
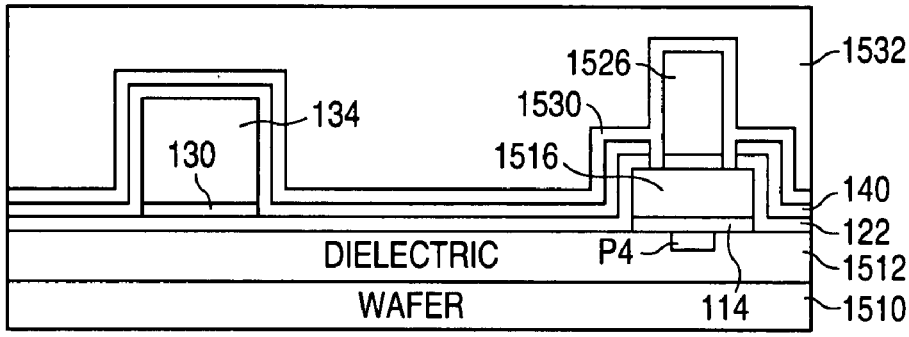
Figure 22A:
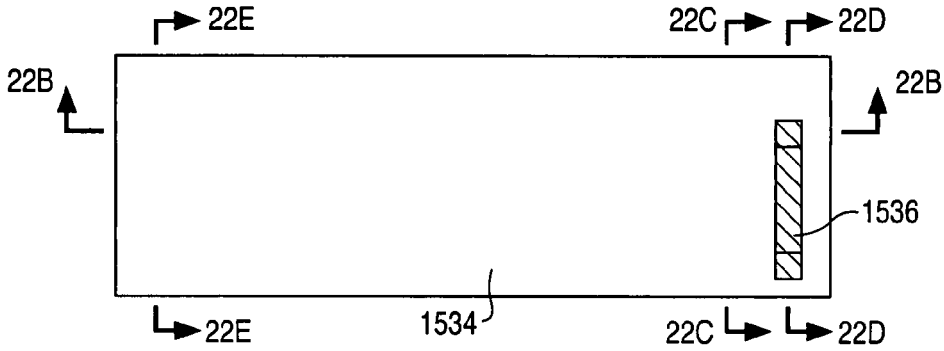
Figure 22B:
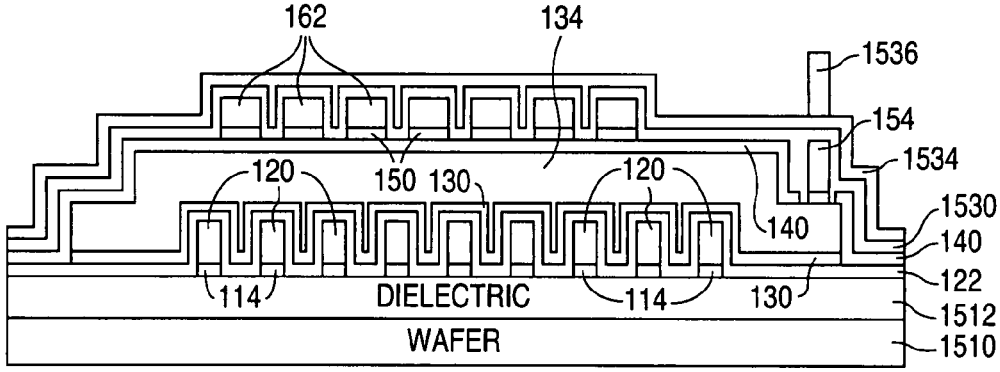
Figure 22C:
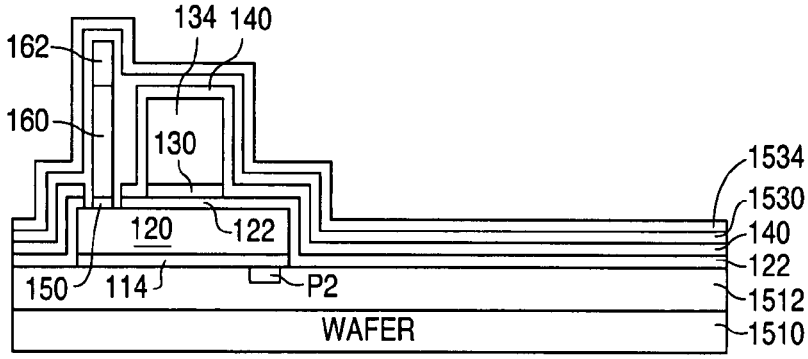
Figure 22D:
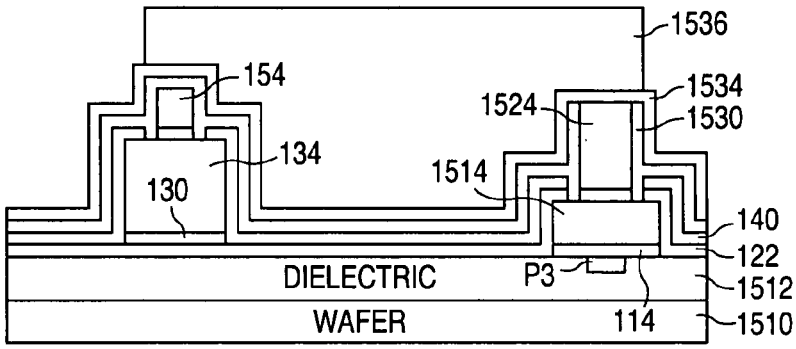
Figure 22E:
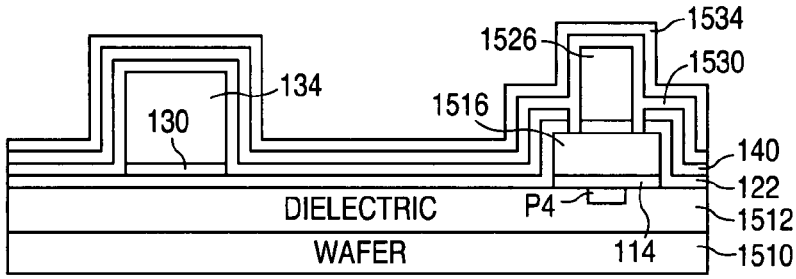
Figure 23A:
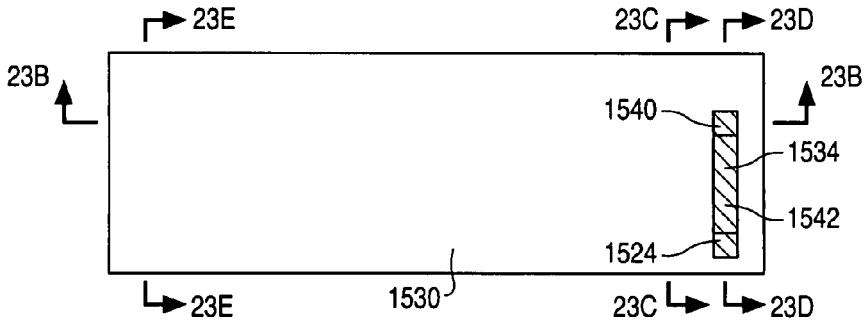
Figure 23B:
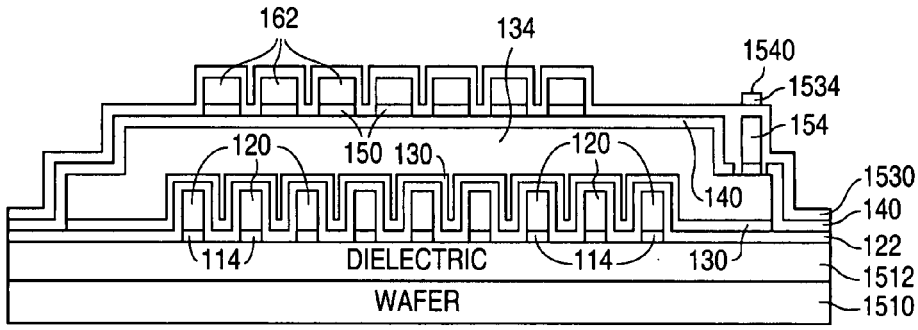
Figure 23C:
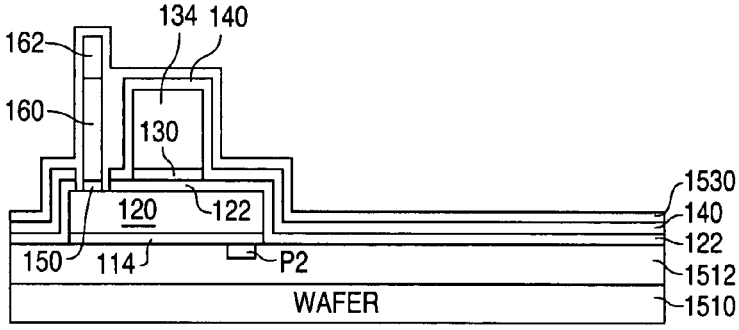
Figure 23D:
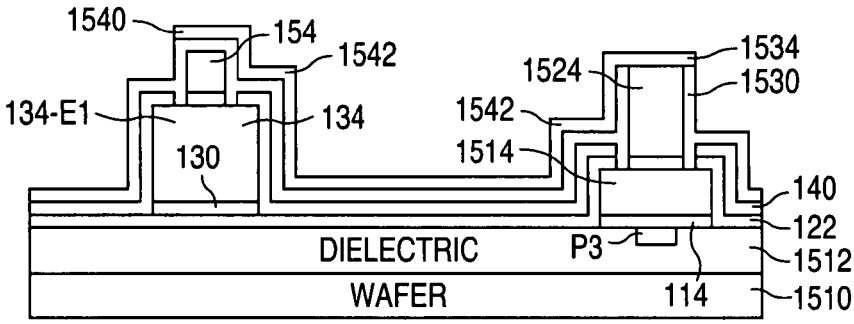
Figure 23E:
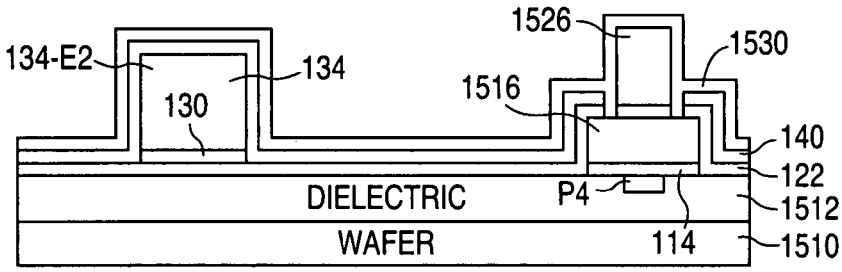
Figure 24A:
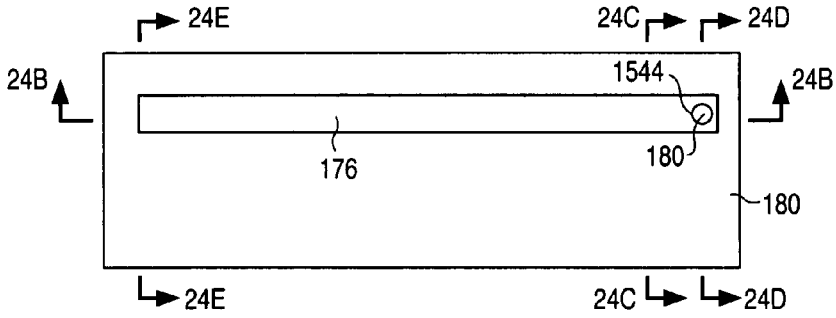
Figure 24B:
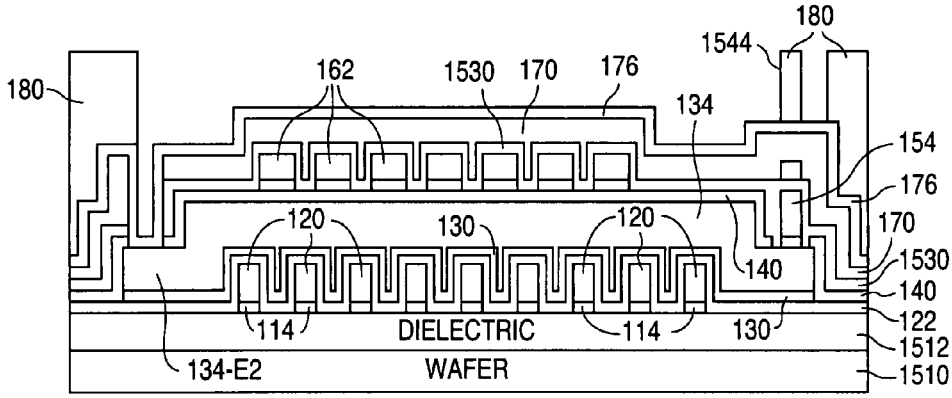
Figure 24C:
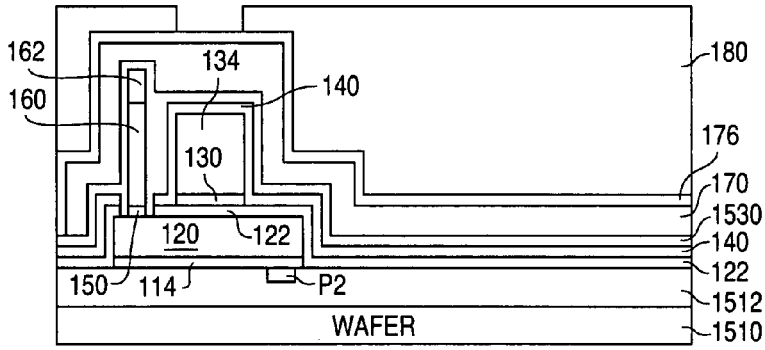
Figure 24D:
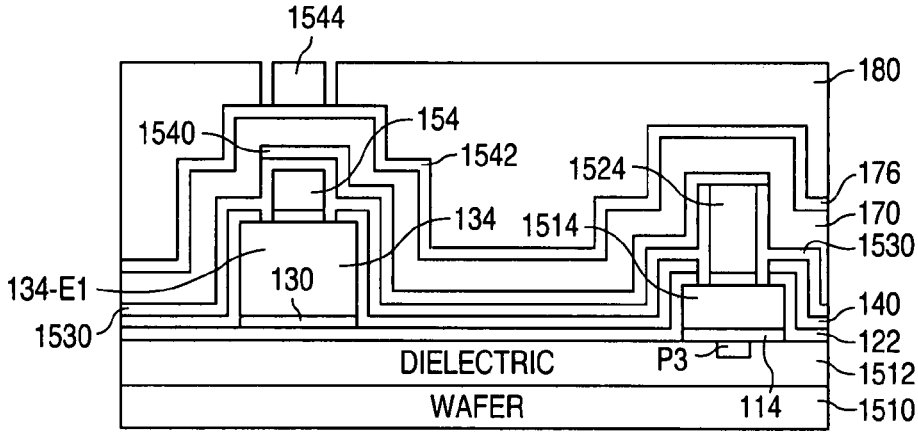
Figure 24E:
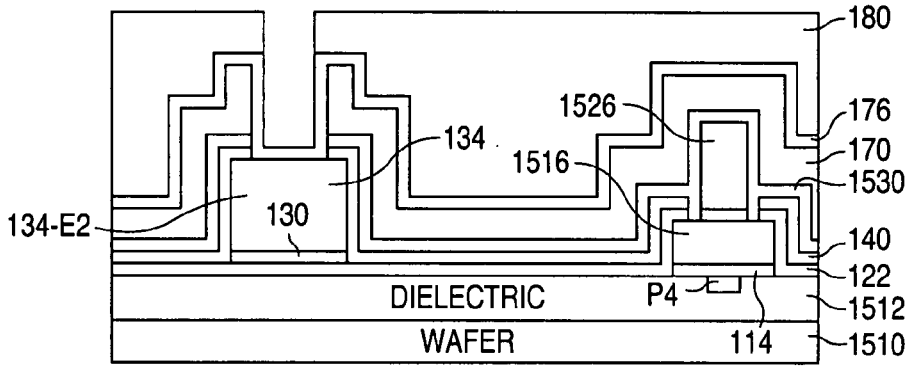
Figure 25A:
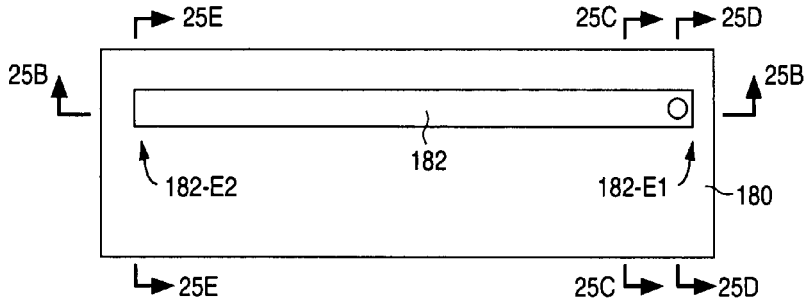
Figure 25B:
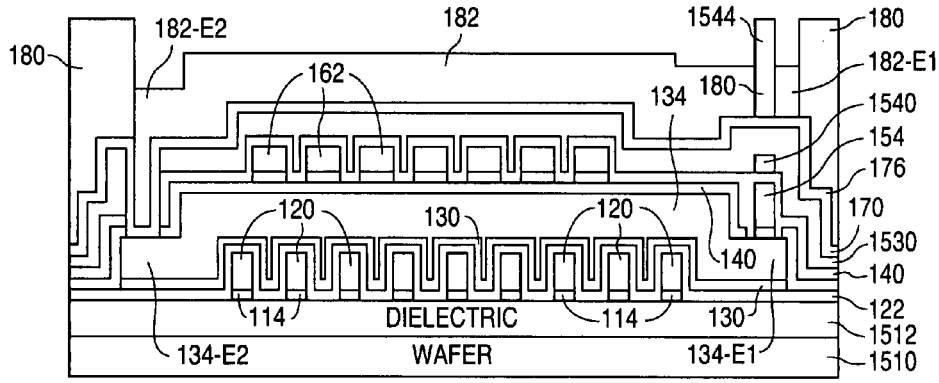
Figure 25C:
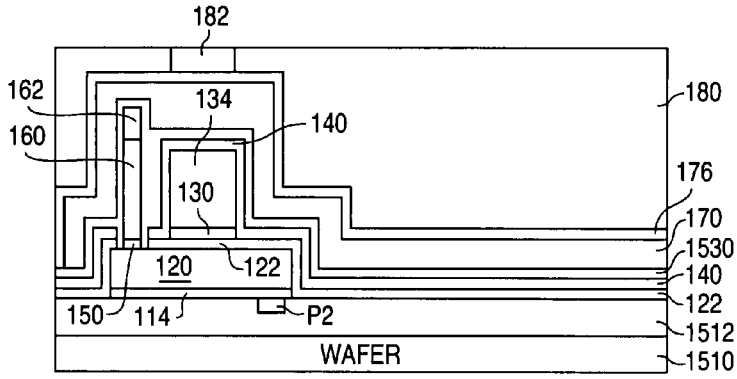
Figure 25D:
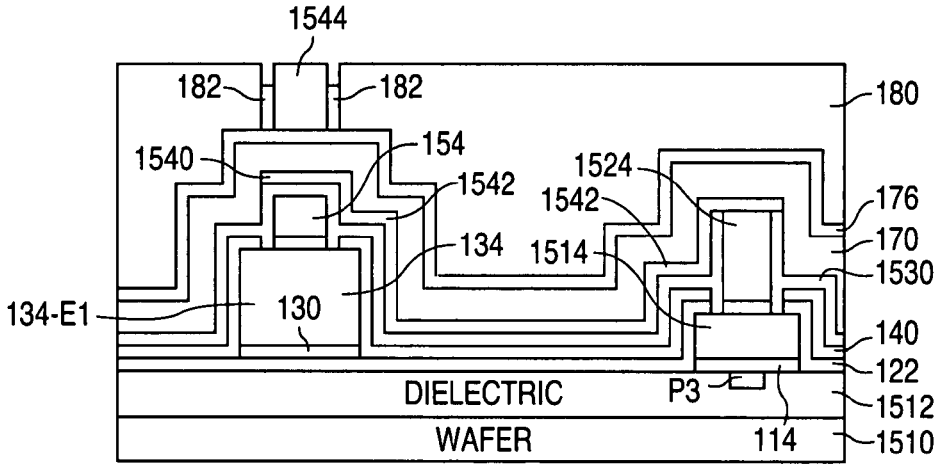
Figure 25E:
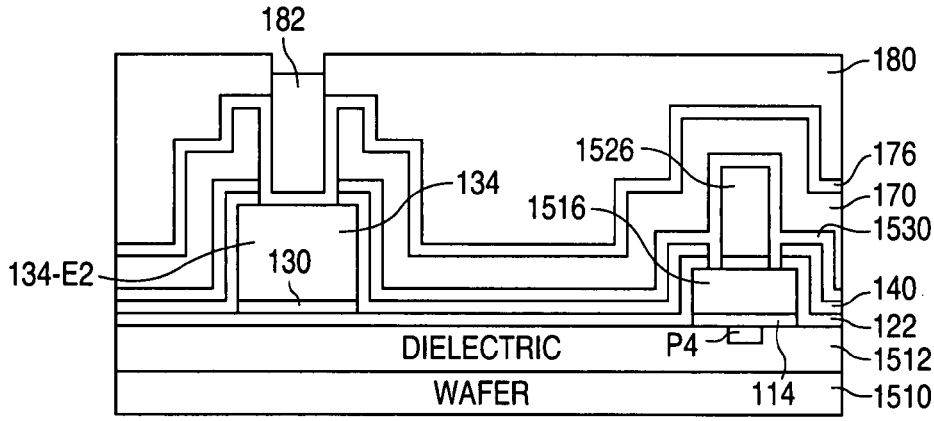
Figure 26A:
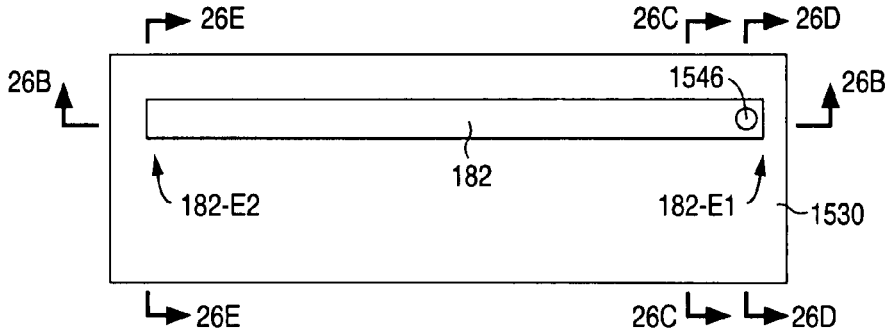
Figure 26B:
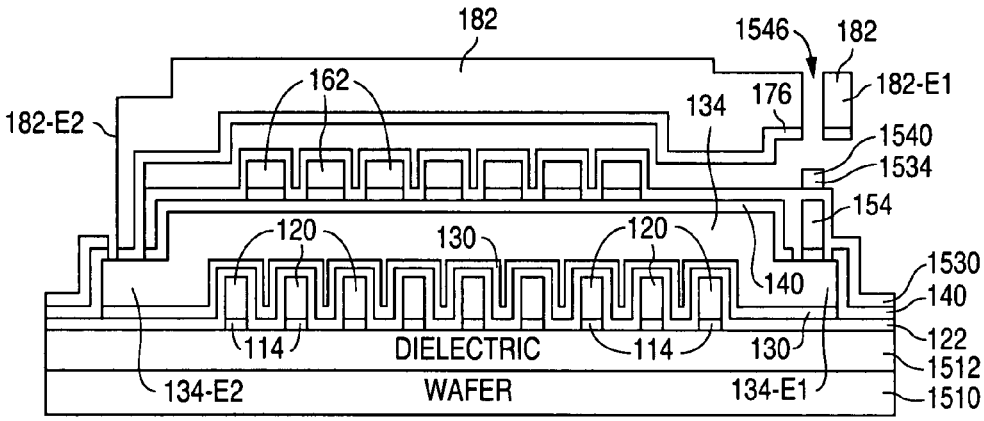
Figure 26C:
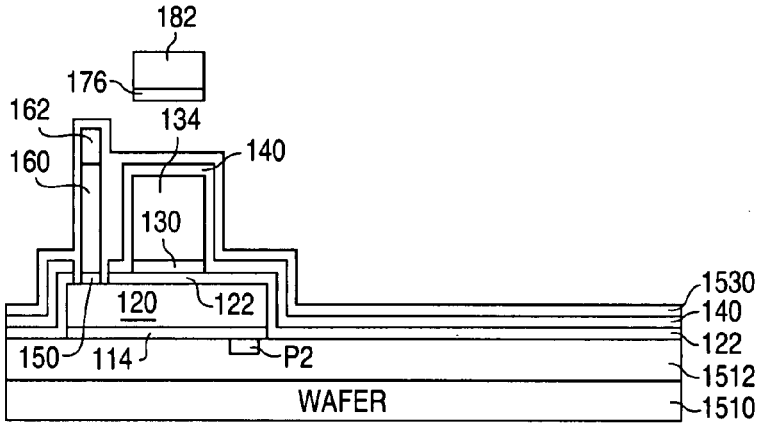
Figure 26D:
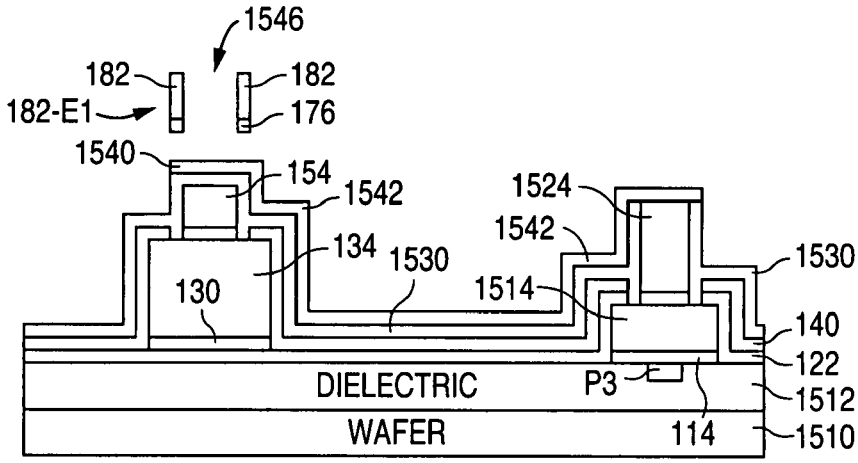
Figure 26E:
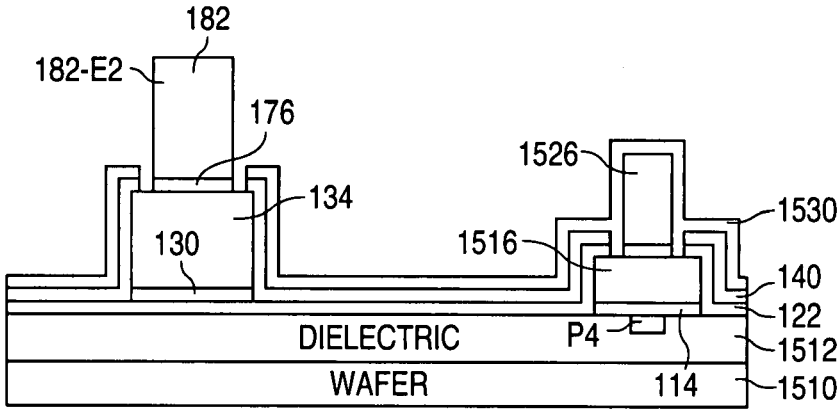
Figure 27A:
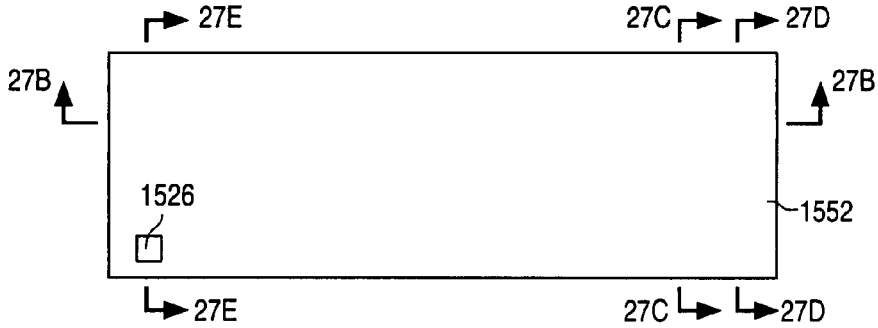
Figure 27B:
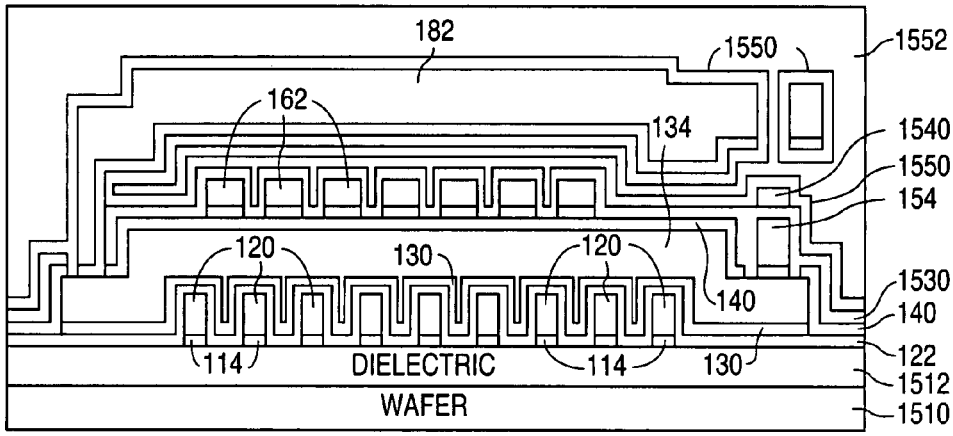
Figure 27C:
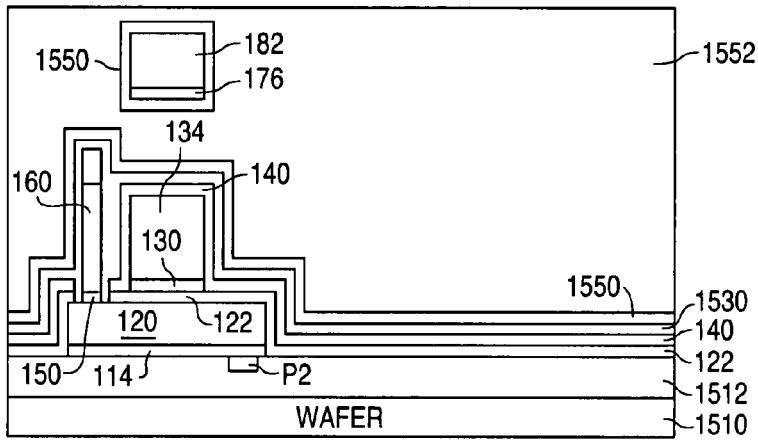
Figure 27D:
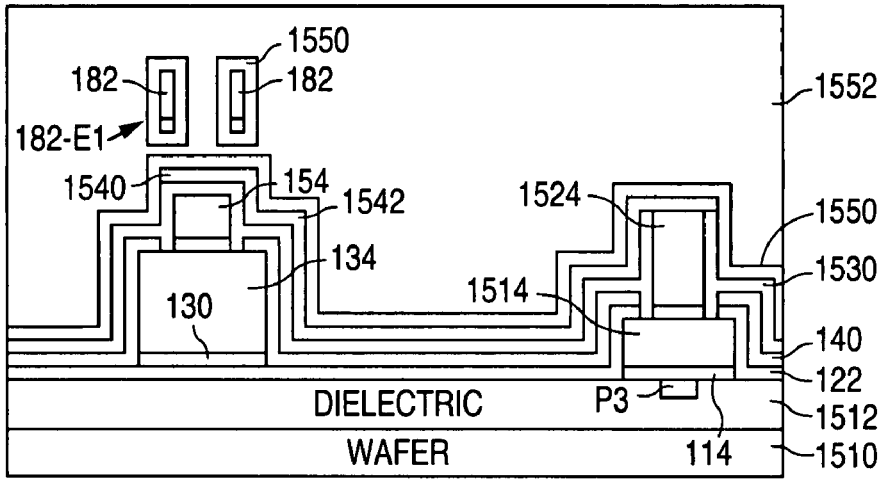
Figure 27E:
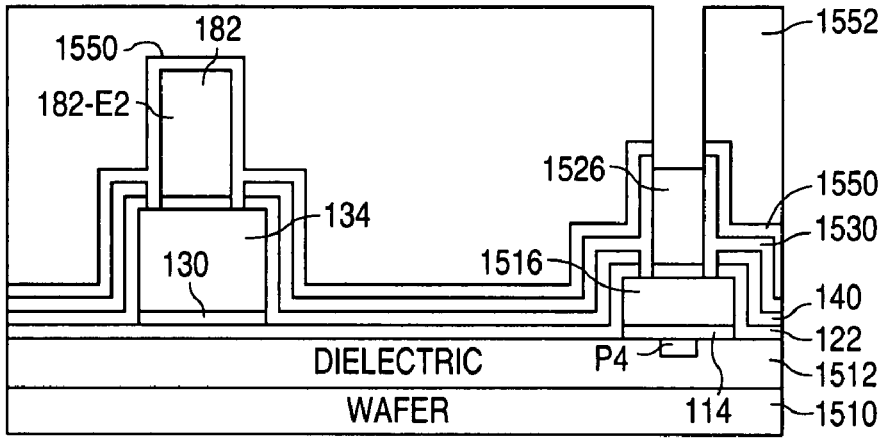
Figure 28A:
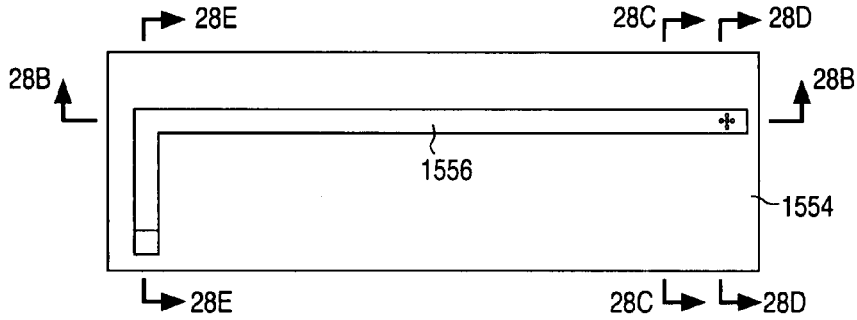
Figure 28C:
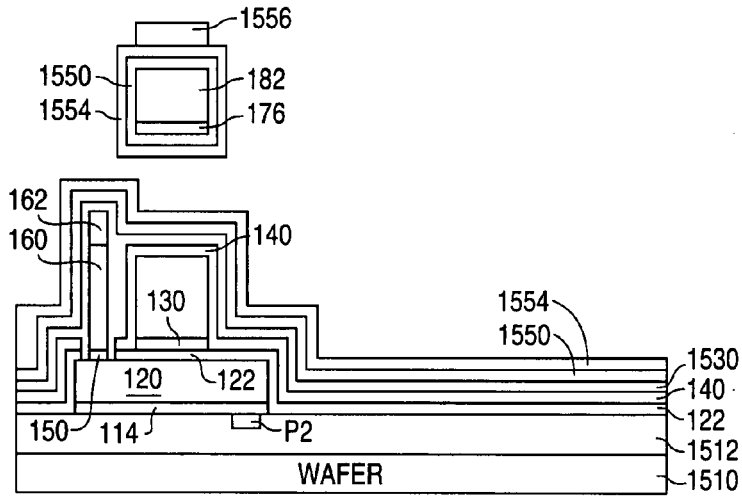
Figure 28D:
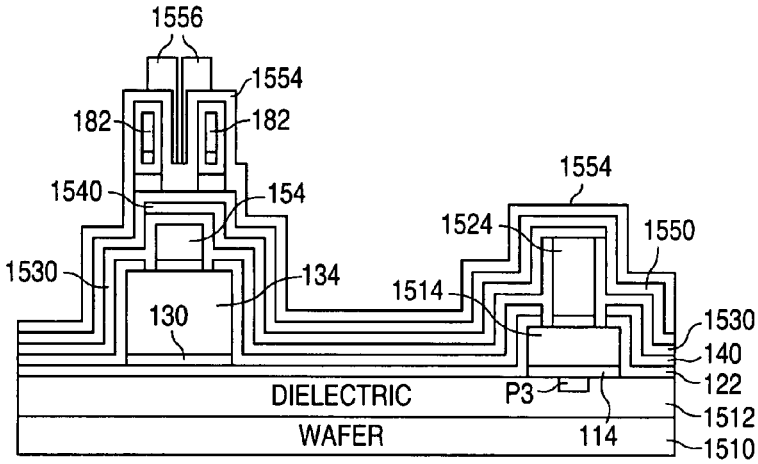
Figure 28B:
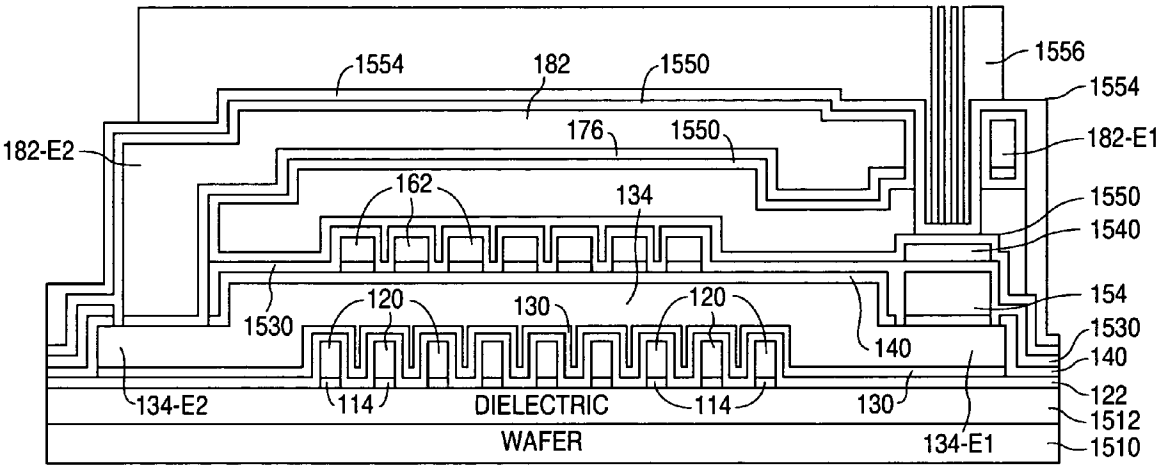
Figure 28E:
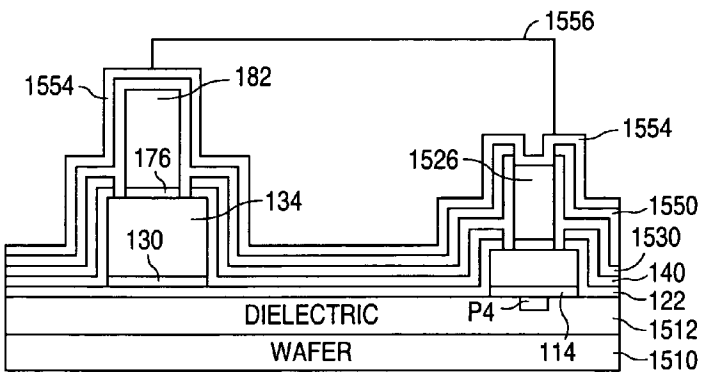

In operation, when no current is present, flexible member 182 has the shape shown in FIG. 14B. As shown, the second end 134-E2 and the floating end 182-E2 are spaced apart, thereby providing a first actuation position. On the other hand, when a current flows through coil 184 and generates an electromagnetic field, the electromagnetic field causes the floating end 182-E1 to move towards the first end 134-E1, thereby providing a second actuation position.

The electromagnetic field is stronger than the spring force of cantilevered flexible member 182, which causes the floating end 182-E1 of cantilevered flexible member 182 to bend towards the first end 134-E1 of core member 134. The force required to achieve good ohmic contact is in the range of 100 μN. Modeling of actuator 100 gives forces in the range of 100 μN for a coil with five windings, a core member that is 500 μm long and 10 μm thick with a Young's modulus of steel (210 GPa). The modeling of actuator 100 also assumed a gap of 3 μm, and 2.75V of bias passed across the coil (approximately 20 mA of current) whose resistance (the coils) is FIGS. 15A-29A, 15B-29B, 15C-29C, 15D-29D, and 15E-29E show a series of views that illustrate a method of forming a MEMS relay 1500 in accordance with the present invention. The method of forming MEMS relay 1500 is similar to the method of forming actuator 100 and, as a result, utilizes the same reference numerals to designate the structures which are common to both methods.

As shown in FIGS. 15A-15E, the method of forming relay 1500 utilizes a conventionally formed single-crystal silicon semiconductor wafer 1510 and an overlying dielectric layer 1512. Like dielectric layer 112, dielectric layer 1512 can represent a dielectric layer that includes no metal structures, or a dielectric layer that includes metal structures, such as the dielectric layer of a metal interconnect structure.

When formed as the dielectric layer of a metal interconnect structure, dielectric layer 1512 includes levels of metal traces, which are typically aluminum, a large number of contacts that connect the bottom metal trace to electrically conductive regions on wafer 1510, and a large number of inter-metal vias that connect the metal traces in adjacent layers together. Further, selected regions on the top surfaces of the metal traces in the top metal layer function as pads which provide external connection points.

In the present example, dielectric layer 1512 represents the dielectric layer of a metal interconnect structure that also includes pads V1-V4. Pads P1 and P2 are selected regions on the top surfaces of two of the metal traces in the top layer of metal traces that provide electrical connections for a to-be-formed square coil, while pads P3 and P4 are selected regions on the top surfaces of two other of the metal traces in the top metal layer that provide electrical connections for a to-be-formed switch. (Only pads P2-P4, and not the entire metal interconnect structure, are shown in cross-section for clarity.)

Referring again to FIGS. 15A-15E, the method of forming relay 1500 begins the same as the method for forming actuator 100, except that seed layer 114 is also formed on pads P3-P4 in addition to pads P1 and P2. Once seed layer 114 has been formed, mask 116 is formed and patterned as before except that the pattern also exposes pads P3 and P4 in addition to pads P1 and P2.

As shown in FIGS. 16A-16E, following the formation and patterning of mask 116, copper is deposited by electroplating as before to form the copper lower sections 120 (the lower sides of the to-be-formed square coil). In addition, copper structures 1514 and 1516 are formed and electrically connected to pads P3 and P4 at the same time that the copper lower sections 120 are formed. After the copper lower sections 120 have been formed, mask 116 is removed, followed by the removal of the underlying regions of seed layer 114.

The method of forming MEMS relay 1500 then follows the same process as described above with respect to FIGS. 3A-3E through 6A-6E up to the formation of mask 142. As shown in FIGS. 17A-17E, mask 142 is formed as above except that the pattern also exposes the regions of dielectric layer 140 that lie over copper structures 1514 and 1516.

Following the formation and patterning of mask 142, as shown in FIGS. 18A-18E, the exposed regions of the dielectric layer 140 and underlying dielectric layer 122 (where present) are etched as before to form vertical openings 144 and vertical opening 146. In addition, the etch also forms a vertical opening 1520 that exposes the top surface of copper structure 1514, and a vertical opening 1522 that exposes the top surface of copper structure 1516. Mask 142 is then removed.

Once mask 142 has been removed, as shown in FIGS. 19A-19E, seed layer 150 is formed as before except that seed layer 150 is also formed on the exposed top surfaces of copper structures 1514 and 1516. After seed layer 150 has been formed, mask 152 is formed and patterned as before, except that mask 152 also exposes the regions of seed layer 150 that lie on the top surfaces of copper structures 1514 and 1516. The pattern (openings) in mask 152 is shown hatched in FIG. 19A.

Next, as shown in FIGS. 20A-20E, following the formation and patterning of mask 152, copper is deposited by electroplating as before to form copper pedestal 154, the copper side sections 160 of the square coil, and the copper upper sections 162 of the square coil. In addition, a copper structure 1524 is formed on copper structure 1514, and a copper structure 1526 is formed on copper structure 1516. Copper pedestal 154, the copper upper sections 162 of the square coil, copper structure 1524, and copper structure 1526 are shown hatched in FIG. 20A. Following this, mask 152 and the underlying regions of seed layer 150 are removed.

As shown in FIGS. 21A-21E, after seed layer 150 has been removed, a dielectric layer 1530 is formed on copper pedestal 154, copper side sections 160, copper upper sections 162, copper structures 1524 and 1526, and dielectric layer 140. After dielectric layer 1530 has been formed, a mask 1532 is formed and patterned on dielectric layer 1530. Following the formation and patterning of mask 1532, the exposed regions of dielectric layer 1530 are etched to expose the top surface of copper structure 1524. Mask 1532 is then removed.

Next, as shown in FIGS. 22A-22E, a conductive layer 1534, such as a layer of titanium, nickel, or chrome, and an overlying layer of gold, is deposited on dielectric layer 1530 and the exposed top surface of copper structure 1524. After conductive layer 1534 has been formed, a mask 1536 is formed and patterned on conductive layer 1534. The region protected by mask 1536 is shown hatched in FIG. 22A.

As shown in FIGS. 23A-23E, following the formation and patterning of mask 1536, the exposed regions of conductive layer 1534 are etched away to form a lower switch plate 1540 that lies over the first end 134-E1 of core member 134, and a trace 1542 that electrically connects lower switch plate 1540 to conductive structure 1524. Mask 1536 is then removed. Lower switch plate 1540 is electrically isolated from the first end 134-E1 of core member 134 by a region of dielectric layer 1530.

The method of forming MEMS relay 1500 then follows the same process as described above with respect to FIGS. 10A-10E through FIGS. 12A-12E up to the formation of mask 180. As shown in FIGS. 24A-24E, mask 180 is formed as above except that the pattern also includes a segment 1544 that lies within the opening in mask 180. Following the formation and patterning of mask 180, as shown in FIGS. 25A-25E, a magnetic material, such as an alloy of nickel and iron like permalloy, is deposited by electroplating to form flexible member 182 as before.

Once flexible member 182 has been formed, as shown in FIGS. 26A-26E, mask 180, the underlying regions of seed layer 176, and sacrificial layer 170 are removed. The removal of mask 180 exposes an opening 1546 that extends completely through flexible member 182. The removal of the underlying regions of seed layer 176 and sacrificial layer 170 releases flexible member 182. As a result, the floating end 182-E1 of flexible member 182 can move vertically towards and away from lower switch plate 1540.

Following this, as shown in FIGS. 27A-27E, a non-conductive layer 1550, such as a layer of plasma oxide, is formed on lower switch plate 1540 and flexible member 182. In the present example, non-conductive layer 1550 is formed to have a thickness on the order of 2 μm. In this case, non-conductive layer 1550 defines the size of the switch gap. After non-conductive layer 1550 has been formed, a mask 1552 is formed and patterned on non-conductive layer 1550. Following the formation and patterning of mask 1552, the exposed regions of non-conductive layer 1550 and underlying dielectric layer 1530 are removed to expose the top surface of copper structure 1526. Mask 1552 is then removed.

Next, as shown in FIGS. 28A-28E, a conductive layer 1554, such as an underlying layer of titanium, nickel, or chrome, and an overlying layer of gold, is deposited on non-conductive layer 1550 and the exposed top surface of copper structure 1526. The layer of gold can have a thickness on the order of, for example, 2 μm. After conductive layer 1554 has been formed, a mask 1556 is formed and patterned on conductive layer 1554. In the present example, mask 1556 includes a number of openings that expose the regions of conductive layer 1554 that lie over lower switch plate 1540.

As shown in FIGS. 29A-29E, following the formation and patterning of mask 1556, the exposed regions of conductive layer 1554 are etched to form an upper switch plate 1560 that lies over lower switch plate 1540, and a trace 1562 that electrically connects upper switch plate 1560 to conductive structure 1526. In addition, upper switch plate 1560, which is electrically isolated from the floating end 182-E1 of flexible member 182 by a region of non-conductive layer 1550, includes a number of pin openings 1564 that extend completely through upper switch plate 1560. Mask 1556 is then removed.

Following this, wafer 1510 is wet etched for a predetermined period of time to remove non-conductive layer 1550. Due to the number, size, and spacing of pin openings 1564, the wet etch is able to remove the non-conductive layer 1550 that lies between lower switch plate 1540 and upper switch plate 1560, thereby releasing flexible member 182. In other words, the size of the pin openings are on the order of the size of the switch gap to ensure that non-conductive layer 1550 is undercut.

As a result, upper switch plate 1560 is vertically separated from lower switch plate 1540 by a switch gap 1566 that is defined by the thickness of non-conductive layer 1550. The thickness of a plasma oxide layer can be accurately controlled. As a result, the distance that separates upper switch plate 1560 from lower switch plate 1540 can be accurately controlled. In the present example, the size of gap 1566 is on the order of 2 μm.

To complete the formation of relay 1500, wafer 1510 is wet etched to remove the underlying layer of titanium, nickel, or chrome from the conductive layer 1554 that forms upper switch plate 1560. As a result, only a gold portion of upper switch plate 1560 touches the gold portion of lower switch plate 1540.

Thus, a method of forming relay 1500 has been described. As shown in FIGS. 29A-29E, relay 1500 is the same as actuator 100 except that relay 1500 includes a switch 1568 that has a lower electrode 1570 and an upper electrode 1572. Lower electrode 1570 is implemented with lower switch plate 1540, trace 1542, and dielectric layer 1530. Upper electrode is implemented with upper switch plate 1560, trace 1562, and non-conductive layer 1550.

Figure 29A:
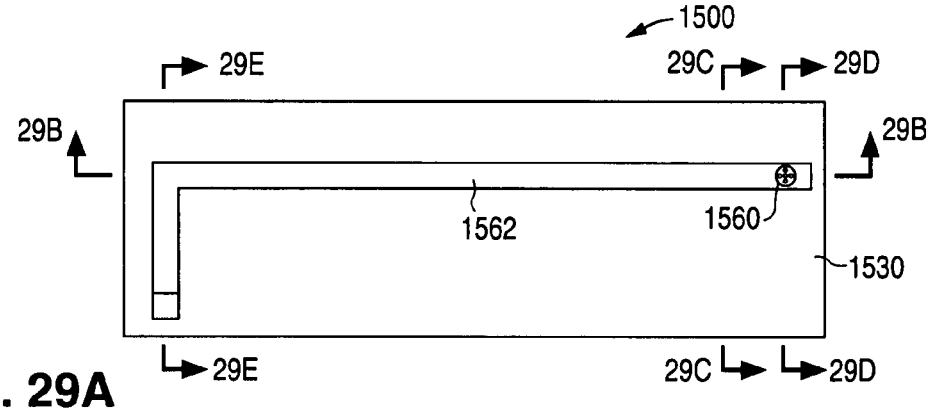
Figure 29C:
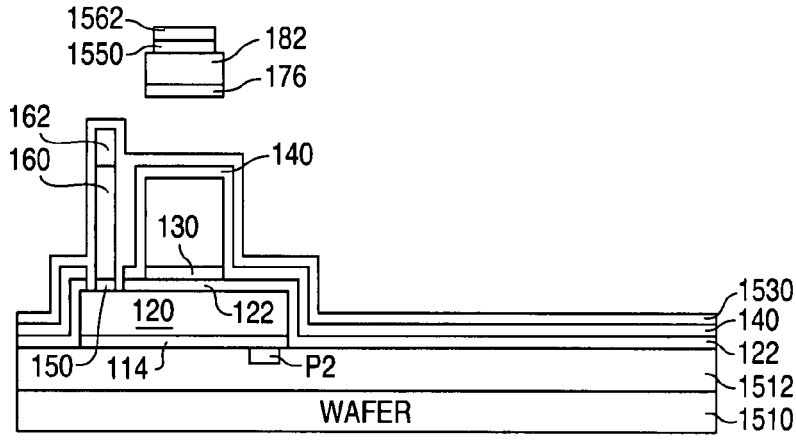
Figure 29D:
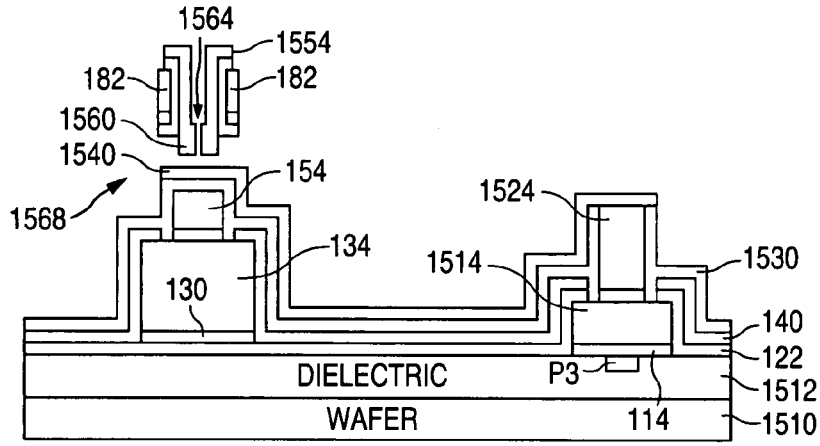
Figure 29B:
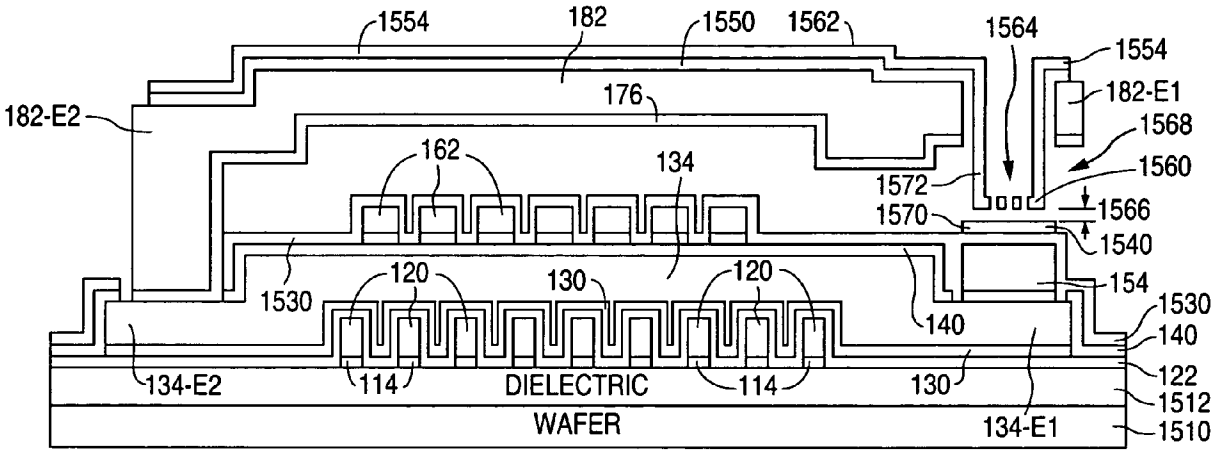
Figure 29E:
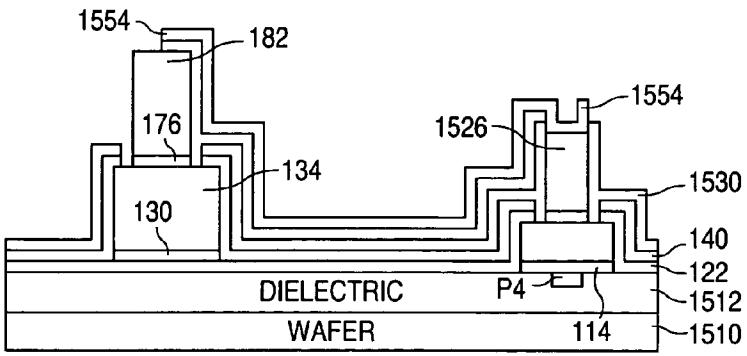

In operation, when no current is present, flexible member 182 has the shape shown in FIG. 29B. As shown, lower electrode 1570 and upper electrode 1572 are spaced apart by gap 1566, thereby providing a high-impedance electrical pathway. On the other hand, when a current flows through coil 184 and generates an electromagnetic field that is stronger than the spring force of cantilevered flexible member 182, the floating end 182-E1 of cantilevered flexible member 182 bends towards the first end 134-E1 of core member 134 so that the upper switch plate 1560 of upper electrode 1572 touches the lower switch plate 1540 of lower electrode 1570, thereby providing a low-impedance electrical pathway.

As noted above, dielectric layers 112 and 1512 can represent a dielectric layer that is free of metal structures. When free of metal structures, the electrical connections to coil 184 can be made, for example, by wire bonding to points on the copper upper sections 162 that represent opposite ends of coil 184. In addition, connections to the lower and upper electrodes 1570 and 1572 can be made, for example, by wire bonding to traces 1542 and 1562.

One of the advantages of the present invention is that the present invention requires relatively low processing temperatures. As a result, the present invention is compatible with conventional backend CMOS processes.

It should be understood that the above descriptions are examples of the present invention, and that various alternatives of the invention described herein may be employed in practicing the invention. For example, the various seed layers can be implemented as copper seed layers, or as tungsten, chrome, or combination seed layers as need to provide the correct ohmic and mechanical (peel) characteristics. Thus, it is intended that the following claims define the scope of the invention and that structures and methods within the scope of these claims and their equivalents be covered thereby.

What is claimed is:

1. A method of forming a MEMS device on a first non-conductive layer that lies over a semiconductor material, the method comprising:

forming a plurality of lower coil sections that touch the first non-conductive layer, the plurality of lower coil sections being conductive;

forming a second non-conductive layer that touches the plurality of lower coil sections;

forming a core section of an actuation member that touches the second non-conductive layer and lies over the plurality of lower coil sections, the actuation member being conductive;

forming a third non-conductive layer that touches the core section;

forming a plurality of upper coil sections that touch the third non-conductive layer and lie over the core section; and forming a cantilever section of the actuation member that lies vertically over the plurality of upper coil sections.

2. The method of claim 1 wherein:

the core section has an end; and the cantilever section has an end, the end of the cantilever section being vertically movable towards the end of the core section.

3. The method of claim 2 wherein the cantilever section touches the core section.

4. The method of claim 3 wherein an air gap lies between the cantilever section and an upper coil section of the plurality of upper coil sections.

5. The method of claim 2 and further comprising forming a sacrificial layer on the plurality of upper coil sections before the cantilever section is formed, the cantilever section being formed on the sacrificial layer directly over the core section.

6. The method of claim 5 and further comprising removing the sacrificial layer after the cantilever section has been formed.

7. The method of claim 2 and further comprising forming a plurality of side coil sections that touch the plurality of lower coil sections when the plurality of upper coil sections are formed, the plurality of lower coil sections, the plurality of side coil sections, and the plurality of upper coil sections being electrically connected together to form a coil.

8. The method of claim 7 wherein the core section extends through the coil so that opposite ends of the core section lie outside of the coil.

9. The method of claim 8 wherein the cantilever section lies outside of the coil.

10. The method of claim 2 and further comprising forming a conductive region that lies over the end of the core section before the cantilever section is formed.

11. The method of claim 10 wherein the cantilever section is formed with an opening that extends through the cantilever section at the end of the cantilever section.

12. The method of claim 11 and further comprising forming a fourth non-conductive layer on the conductive region and the cantilever section.

13. The method of claim 12 and further comprising forming a conductive material on the fourth non-conductive layer over the cantilever section and the conductive region.

14. The method of claim 13 and further comprising selectively removing the conductive material to form a conductive structure that lies over the cantilever section, the conductive structure including a contact section that extends through the opening at the end of the cantilever section.

15. The method of claim 14 wherein the contact section includes a number of openings that extend through the contact section.

16. The method of claim 15 and further comprising removing the fourth non-conductive layer that lies on the conductive region.

17. The method of claim 3 wherein each lower coil section of the plurality of lower coil sections includes a seed layer and an overlying metallic layer.

18. The method of claim 17 wherein the actuation member includes a magnetic material.

19. The method of claim 18 wherein the magnetic material is an alloy of nickel and iron.

20. The method of claim 19 wherein the actuation member includes a seed layer and an overlying metallic layer.

* * * * *

UNITED STATES PATENT AND TRADEMARK OFFICE

CERTIFICATE OF CORRECTION

PATENT NO. : 7,464,459 B1
APPLICATION NO. : 11/807161
DATED : December 16, 2008
INVENTOR(S) : Niblock et al.

It is certified that error appears in the above-identified patent and that said Letters Patent is hereby corrected as shown below:

Title Page,

Item (56) References Cited, U.S. PATENT DOCUMENTS, Page 1, Col. 2, for Sato et al. delete U.S. Cl. "257/415" and replace with --438/942--.

Item (56) References Cited, OTHER PUBLICATIONS, Page 2, Col. 1, for Han S. Lee, et al. delete "HOLM Conference" and replace with --HOLM Conference on--.

Column 5,

Line 19, delete "(the coils) is" and replace with --(the coils) is $3X10^{-8}\Omega m^{-1}$.--.

Signed and Sealed this

Tenth Day of February, 2009

John Doll

JOHN DOLL
*Acting Director of the United States Patent and Trademark Office*